US010369448B2

(12) United States Patent
Bowman et al.

(10) Patent No.: US 10,369,448 B2
(45) Date of Patent: Aug. 6, 2019

(54) GOLF TRAINING APPARATUS

(71) Applicant: Squared Up Corporation, Denver, CO (US)

(72) Inventors: Michael G. Bowman, Arvada, CO (US); Randy B. Bowman, Denver, CO (US)

(73) Assignee: Squared Up Corporation, Newnan, GA (US)

( * ) Notice: Subject to any disclaimer, the term of this patent is extended or adjusted under 35 U.S.C. 154(b) by 0 days.

(21) Appl. No.: 15/280,545

(22) Filed: Sep. 29, 2016

(65) Prior Publication Data

US 2017/0014703 A1 Jan. 19, 2017

Related U.S. Application Data

(63) Continuation-in-part of application No. 13/050,619, filed on Mar. 17, 2011, now abandoned.

(60) Provisional application No. 61/318,172, filed on Mar. 26, 2010.

(51) Int. Cl.
*A63B 69/36* (2006.01)
*A63B 102/32* (2015.01)

(52) U.S. Cl.
CPC ..... *A63B 69/3667* (2013.01); *A63B 69/3623* (2013.01); *A63B 69/3676* (2013.01); *A63B 69/3614* (2013.01); *A63B 2102/32* (2015.10); *A63B 2207/02* (2013.01); *A63B 2220/803* (2013.01); *A63B 2225/50* (2013.01)

(58) Field of Classification Search
CPC ..... A63B 69/3667; A63B 69/3623; A63B 69/3676; A63B 69/3614; A63B 2102/32; A63B 2207/02; A63B 2220/803; A63B 2220/50; A63B 2225/50
See application file for complete search history.

(56) References Cited

U.S. PATENT DOCUMENTS

| | | | |
|---|---|---|---|
| 5,217,228 | A | 6/1993 | De Aguilar |
| 5,527,041 | A | 6/1996 | Terry, III et al. |
| 5,632,689 | A | 5/1997 | Duca |
| 5,725,440 | A | 3/1998 | Finney |
| 7,025,688 | B1 | 4/2006 | Hatzikostantis |

(Continued)

FOREIGN PATENT DOCUMENTS

| | | |
|---|---|---|
| JP | 2009-119072 | 6/2009 |
| JP | 2010-201159 | 9/2010 |

(Continued)

OTHER PUBLICATIONS

Golf WRX "This putting laser from Laser Optics could be revolutionary," http://www.golfwrx.com/377240/this-putting-laser-from-laser-optics-could-be-revolutionary/ accessed on May 11, 2017; 5 pages.

(Continued)

*Primary Examiner* — Werner G Garner
(74) *Attorney, Agent, or Firm* — Adsero IP

(57) ABSTRACT

Novel tools and techniques for teaching a player the proper alignment when addressing a golf ball. In one aspect, such tools and techniques provide an alignment aid that allows the player to visualize both the intended target line of the shot as well as the position of the ball relative to the player's stance, allowing the player to easily modify his stance to obtain the proper alignment.

16 Claims, 31 Drawing Sheets

(56) References Cited

U.S. PATENT DOCUMENTS

| | | | | |
|---|---|---|---|---|
| 7,112,145 | B2 | 9/2006 | Gaddy | |
| 7,602,301 | B1 | 10/2009 | Stirling et al. | |
| 7,727,079 | B1 | 6/2010 | Kuhlman, Jr. | |
| 2004/0177523 | A1* | 9/2004 | Chang | G01C 15/004 33/281 |
| 2005/0198845 | A1* | 9/2005 | Robinson | G01C 15/004 33/227 |
| 2006/0040757 | A1 | 2/2006 | Rosselli | |
| 2006/0122001 | A1* | 6/2006 | Gaddy | A63B 69/3614 473/220 |
| 2007/0243942 | A1 | 10/2007 | Elliott | |
| 2007/0243944 | A1* | 10/2007 | Paukune | A63B 24/0003 473/267 |
| 2008/0207347 | A1* | 8/2008 | Rose | A63B 69/3614 473/222 |
| 2009/0017929 | A1 | 1/2009 | Zhang | |
| 2010/0243833 | A1* | 9/2010 | Kane, Jr. | B25C 5/1651 248/206.5 |
| 2010/0267460 | A1* | 10/2010 | Kuhlman, Jr. | A63B 69/3614 473/220 |
| 2010/0304877 | A1 | 12/2010 | Iwahashi et al. | |
| 2012/0040768 | A1* | 2/2012 | Allen | A63B 69/3614 473/157 |

FOREIGN PATENT DOCUMENTS

| | | |
|---|---|---|
| JP | 6405018 B2 | 10/2018 |
| WO | WO-2002-070082 | 9/2002 |
| WO | WO-2009-069698 | 4/2009 |

OTHER PUBLICATIONS

International Preliminary Report on Patentability prepared by the International Bureau of WIP for PCT International Patent Application No. PCT/US2011/028865, dated Oct. 2, 2012, 8 pages.
New Zealand Patent Application No. 603221, Office Action dated Jul. 26, 2013, 2 pages.
Chinese Patent Application No. 201180016324.9, Office Action dated Apr. 1, 2014, 13 pages.
Australian Patent Application No. 2011229765, Office Action dated Apr. 17, 2014, 3 pages.
Supplemental European Search Report and Opinion for European Patent Application No. 11759943.1, dated Jul. 2, 2014, 6 pages.
Chinese Patent Application No. 201180016324.9, Office Action dated Dec. 1, 2014; English Translation 9 pages; Chinese Translation 7 pages.
New Zealand Patent Application No. 603221, Office Action dated Jan. 7, 2015, 2 pages.
Australian Patent Application No. 2011229765, Office Action dated Apr. 14, 2015; 3 pages.
Japanese Patent Application No. 2015-166651, Office Action dated Sep. 20, 2016; Japan 2 pages; English Translation 2 pages.
Thailand Patent Application No. 1201005020, Office Action dated Aug. 17, 2018; 26 pages.
India Patent Application No. 3145/KOLNP/2012, Office Action dated Oct. 9, 2018; 8 pages.

* cited by examiner

700

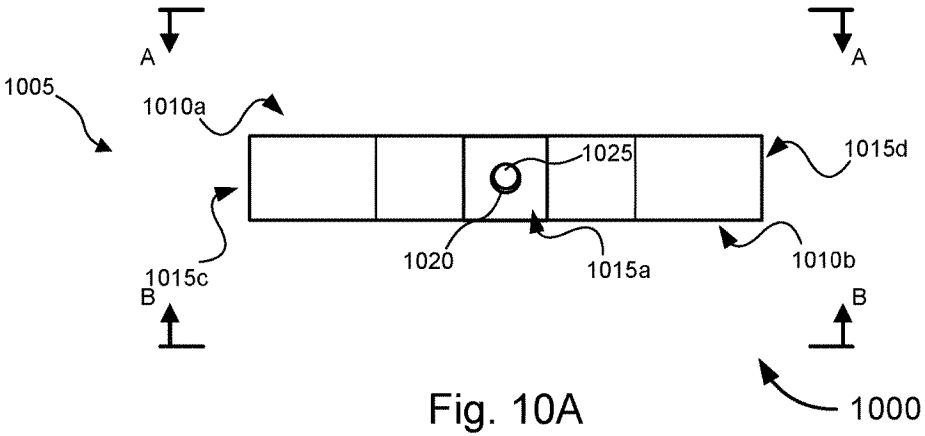
Fig. 10A
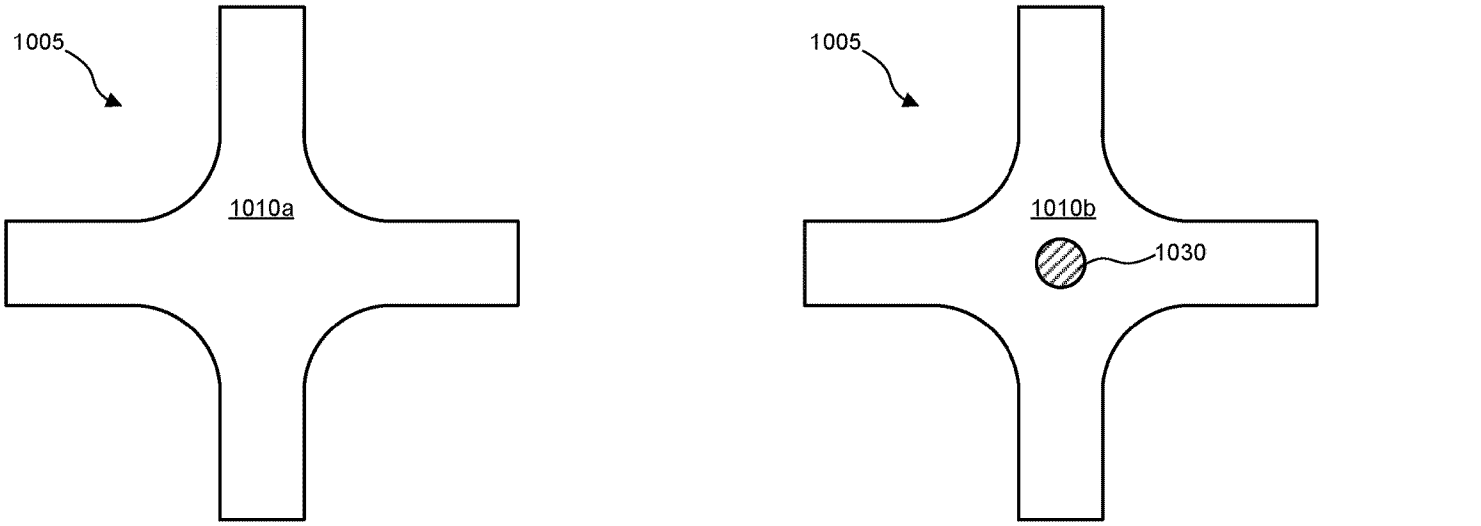
Fig. 10B
Fig. 10C

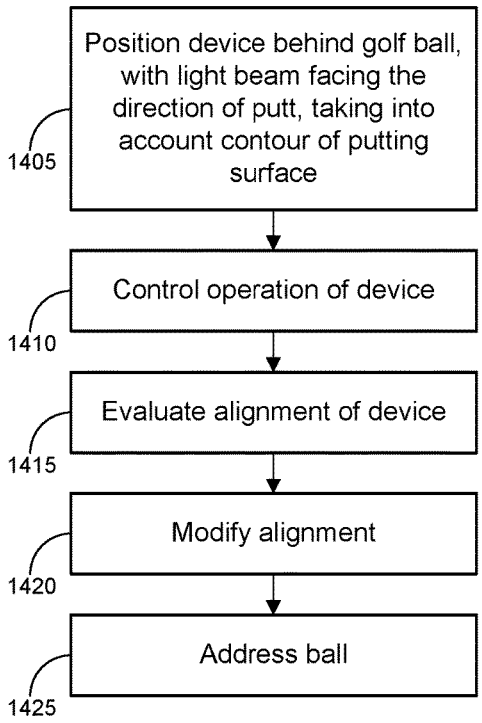
Fig. 14A 1400
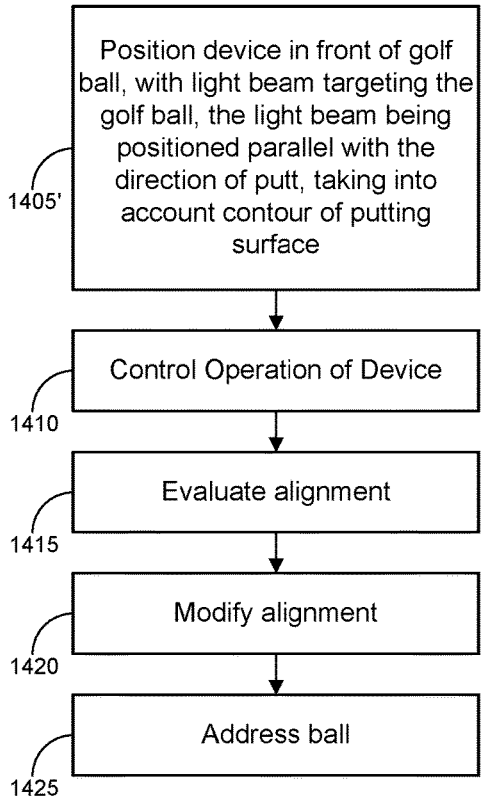
Fig. 14B 1400'

GOLF TRAINING APPARATUS

CROSS-REFERENCE TO RELATED APPLICATIONS

This application is a continuation-in-part of U.S. patent application Ser. No. 13/050,619 (the "'619 application"), filed on Mar. 17, 2011 by Michael G. Bowman et al. and titled, "Golf Training Apparatus", which claims priority to provisional U.S. Patent Application No. 61/318,172 (the "'172 application"), filed Mar. 26, 2010 by Michael G. Bowman et al. and entitled "Golf Training Apparatus", the entire disclosure of each of which is incorporated herein by reference in its entirety for all purposes.

COPYRIGHT STATEMENT

A portion of the disclosure of this patent document contains material that is subject to copyright protection. The copyright owner has no objection to the facsimile reproduction by anyone of the patent document or the patent disclosure as it appears in the Patent and Trademark Office patent file or records, but otherwise reserves all copyright rights whatsoever.

BACKGROUND

In the sport of golf, experienced players understand the importance of "squaring up" to the target and to the ball at address. As a general formulation, the concept of "squaring up" means to align one's body when addressing the golf ball to ensure that the player is appropriately positioned with respect to both the golf ball and the intended target of the player's shot. A player, in general, hits the ball in the direction in which the player is aligned, and if this alignment does not correspond to the intended target, then the shot most likely will be off line also. With consistency in the setup and address, a player will be more confident in his ability to repetitively hit the ball squarely and in the direction intended.

For inexperienced players, however, the correct alignment is often unintuitive and difficult to master. As a result, an inexperienced player will often develop a habitual misalignment at address, and may introduce swing flaws as an unconscious attempt to compensate for this misalignment. Golf instructors traditionally have used several techniques in attempting to teach proper alignment to students. Such techniques include the use of 2 clubs placed on the ground, plastics rods/sticks, and/or the like. Such techniques are of limited effectiveness, especially when practiced by inexperienced players without the guidance of an instructor.

Hence, there is a need for more robust techniques and tools to train players of all abilities the correct alignment when addressing a golf ball. It would be helpful if such tools and techniques could be implemented by an inexperienced player without the need for professional instruction, and/or if such tools could be easily transported (e.g., in a typical golf bag) and set up, to allow a player to engage in training without significant logistical difficulties.

BRIEF SUMMARY

A set of embodiments, therefore, provides improved tools and techniques for teaching a player the proper alignment when addressing a golf ball. In one aspect, certain embodiments provide an alignment aid that allows the player to visualize both the intended target line of the shot as well as the position of the ball relative to the player's stance, allowing the player to easily modify his stance to obtain the proper alignment. In certain embodiments, such tools can also allow the player to verify a number of other important details, such as clubface alignment, location of the hands at address, the divot location (after the shot) relative to the original ball position.

One set of embodiments provides a golf training apparatus. In general, the golf training apparatus might be configured to project one or more beams of visible light to assist in the alignment of a user relative to a target location and/or a ball position.

An exemplary apparatus might comprise a housing. The apparatus, in an aspect of some embodiments, might have one or more light-emitting devices (e.g., one or more lasers, a rotating laser, one or more light-emitting diodes, etc.) disposed at least partially within the housing. (In other cases, the light-emitting devices might be disposed external to the housing, e.g., coupled with an exterior surface of the housing, etc.) In another aspect, the lasers (or other light-emitting devices) might emit one or more beams of light within a visible spectrum.

In some cases, the apparatus will further comprise a beam alignment device, which also might be disposed within the housing. In some embodiments, the beam alignment device is configured to direct a first beam of light along a target axis defining an intended target line of a golf ball struck by a user. In other embodiments, the beam alignment device might be configured to direct a second beam of light along an alignment axis corresponding to a stationary position of the golf ball relative to a stance of the user. A variety of beam alignment devices are possible in different embodiments. Merely by way of example, in some cases, a beam alignment device might merely comprise a fitting that is designed to hold one or more light-emitting devices in a specified orientation. In other cases, a beam alignment device might comprise one or more prisms, such as cylindrical prisms, triangular prisms, one or more lenses, such as lenticular lenses, etc.

In certain embodiments, the apparatus further comprises a control device to receive input from the user and/or a control circuit, which might be in electrical communication with the light-emitting device(s) and/or the control device. In some cases, the control device might comprise a button, accelerometer, etc., which can allow for control of the apparatus by manipulation. In other cases, the control device might comprise a remote control receiver, a Bluetooth receiver, and/or the like. In a particular aspect, the input from the user might comprise control signals received from a remote control device, a wireless phone, and/or the like. In an aspect, the control circuit might be configured to control operation of the light-emitting device(s), e.g., based at least in part on input received by the control device.

In another aspect, the apparatus might further comprise a base having a surface configured to be placed on the ground. The housing, then, might be disposed on the base and/or coupled with the base. (In some cases, the base may be incorporated within the housing.) In an aspect, the base might be configured to allow the housing to rotate relative to the ground. In another aspect, the base might be configured to allow the housing to be disposed at a variable angle relative to horizontal.

Another set of embodiments provides golf training systems. A system in accordance with one set of embodiments might comprise a golf training apparatus (e.g., such as the apparatus described above), along with a remote control facility. One example of a remote control facility can be a software application comprising instructions executable by a computing device (such as wireless phone, handheld computer, tablet computer, laptop computer, etc., to name a few examples), to control operation of the golf training apparatus (e.g., by transmitting signals to be received by the control device in the golf training apparatus). In another aspect, the remote control facility might be a dedicated remote control device separate from the golf training apparatus; the remote control device being configured to receive input from a user and to transmit signals to control operation of the golf training apparatus based at least in part on input from the user.

Yet another set of embodiments provides golf training methods. An exemplary method might comprise aligning a golf training apparatus (such as the apparatus described above, for example) with respect to a target location. The method might further comprise placing the golf ball on the alignment axis, and evaluating an alignment of the user addressing the golf ball, based at least in part on the position of the user relative to at least one of the beams of light. In some cases, the method might further comprise modifying the alignment of the user, based at least in part on the position of the user relative to at least one of the beams of light. In other cases, the method might further comprise controlling operation of the golf training apparatus using a software program on a wireless phone.

Various modifications and additions can be made to the embodiments discussed without departing from the scope of the invention. For example, while the embodiments described above refer to particular features, the scope of this invention also includes embodiments having different combination of features and embodiments that do not include all of the above described features.

BRIEF DESCRIPTION OF THE DRAWINGS

A further understanding of the nature and advantages of particular embodiments may be realized by reference to the remaining portions of the specification and the drawings, in which like reference numerals are used to refer to similar components. In some instances, a sub-label is associated with a reference numeral to denote one of multiple similar components. When reference is made to a reference numeral without specification to an existing sub-label, it is intended to refer to all such multiple similar components.

FIGS. 10A-10G illustrate various views of another golf training system including still another embodiment of a golf training apparatus as well as another embodiment of a mounting base.

FIGS. 14A and 14B are process flow diagrams illustrating various methods of golf training, in accordance with various embodiments.

DETAILED DESCRIPTION OF CERTAIN EMBODIMENTS

Figure 1:
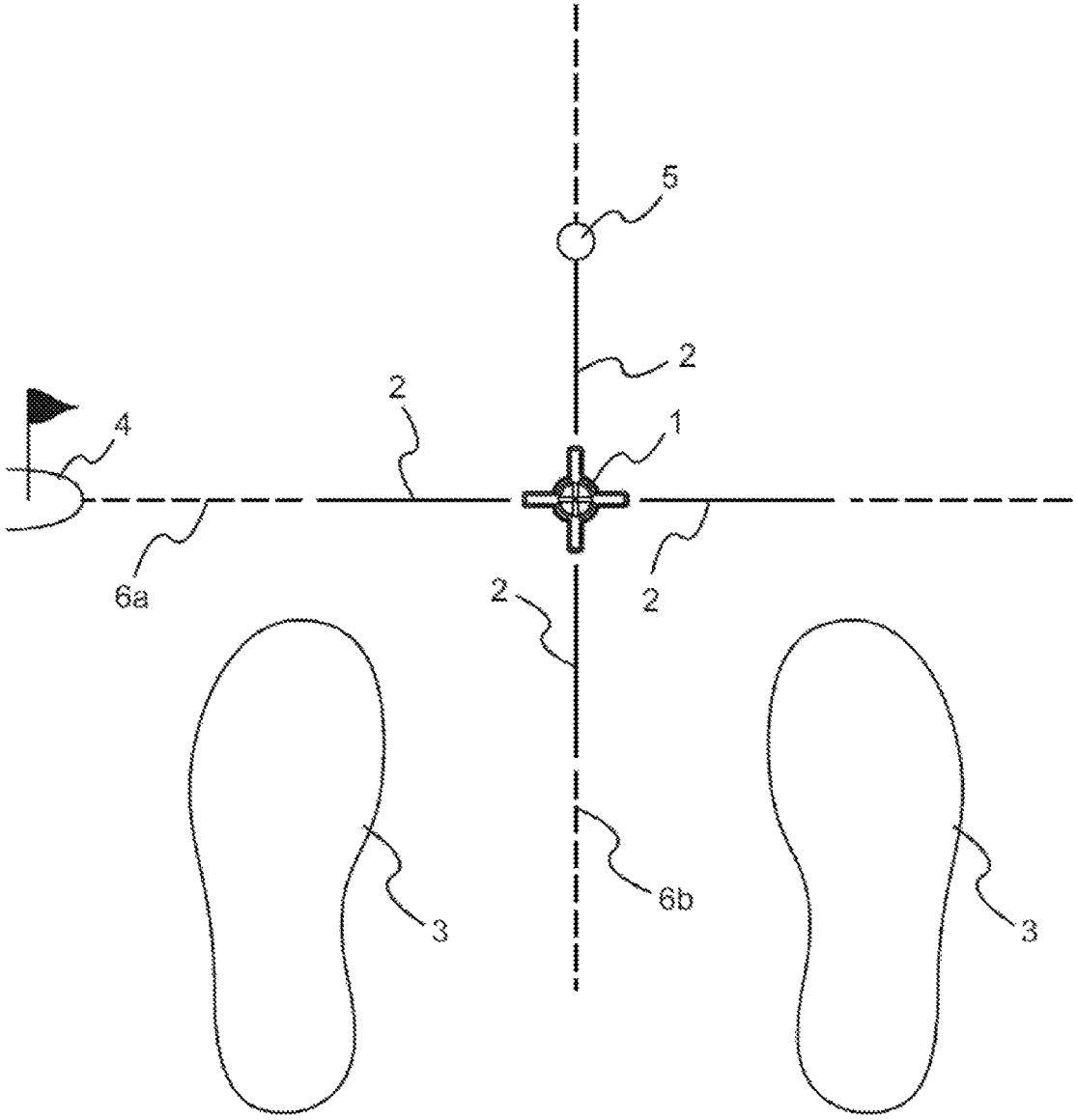
FIG. 1 illustrates a plan view of a golf training apparatus assisting a golfer's alignment with a target line and a ball, in accordance with various embodiments.

While various aspects and features of certain embodiments have been summarized above, the following detailed description illustrates a few exemplary embodiments in further detail to enable one of skill in the art to practice such embodiments. The described examples are provided for illustrative purposes and are not intended to limit the scope of the invention.

In the following description, for the purposes of explanation, numerous specific details are set forth in order to provide a thorough understanding of the described embodiments. It will be apparent to one skilled in the art, however, that other embodiments may be practiced without some of these specific details. In other instances, certain structures and devices are shown in block diagram form. Several embodiments are described herein, and while various features are ascribed to different embodiments, it should be appreciated that the features described with respect to one embodiment may be incorporated with other embodiments as well. By the same token, however, no single feature or features of any described embodiment should be considered essential to every embodiment, as other embodiments may omit such features.

Unless otherwise indicated, all numbers used herein to express quantities, dimensions, and so forth used should be understood as being modified in all instances by the term "about." Similarly, terms of alignment (such as "align," "coaxial," "normal," and their derivatives) used herein should be interpreted to include the term "generally," in recognition that exact precision in such alignment is rarely feasible using typical manufacturing techniques, and that various embodiments should be understood to include alignment with sufficient, if not exact, precision to accomplish the objectives of such embodiments.

In this document, the use of the singular includes the plural unless specifically stated otherwise, and use of the terms "and" and "or" means "and/or" unless otherwise indicated. Moreover, the use of the term "including," as well as other forms, such as "includes" and "included," should be considered non-exclusive. Also, terms such as "element" or "component" encompass both elements and components comprising one unit and elements and components that comprise more than one unit, unless specifically stated otherwise.

As noted above, certain embodiments provide improved tools and techniques for teaching a player the proper alignment when addressing a golf ball. In one aspect, certain embodiments provide an alignment aid that allows the player to visualize both the intended target line of the shot as well as the position of the ball relative to the player's stance, allowing the player to easily modify his stance to obtain the proper alignment. In certain embodiments, such tools can also allow the player to verify a number of other important details, such as clubface alignment, location of the hands at address, the divot location (after the shot) relative to the original ball position, and/or the like.

One set of embodiments, for example, provides a golf training apparatus. One such apparatus projects two lines of light, one corresponding to the intended target line of the ball's flight path and the other corresponding to the ball's position normal to that target line. Other embodiments can project more or fewer lines; for example, one embodiment might project only a line corresponding to the target path, while another embodiment might project a line, in addition to the target line and the position line, that corresponds to the ball's intended flight path to allow the player to align for a draw—in which the ball's flight path curves from right to left for a right-handed player—or fade—in which the ball's flight path curves from left to right for a right-handed player—, while still maintaining the same target axis.

To illustrate, one embodiment provides an apparatus comprising a housing, with one or more light emitting devices (e.g., lasers, light emitting diodes ("LED"), and/or the like) disposed at least partially within the housing (and/or outside the housing). Such devices might operate to emit one or more beams of light within a visible spectrum. In some aspects, the apparatus might further comprise a beam alignment device disposed within the housing; the beam alignment device might be configured to direct a first beam of light along a target axis defining an intended target line of a golf ball struck by a user and to direct a second beam of light along an alignment axis corresponding to a stationary position of the golf ball relative to a stance of the user. In some cases, the apparatus might include a control device to receive input from the user and/or a control circuit in electrical communication with the light emitting devices and the control device; the control circuit thus might be configured to control operation of the one or more lasers, based at least in part on input received by the control device.

A number of variations are possible. Merely by way of example, in some cases, the light emitting device(s) might comprise one or more lasers, and in particular embodiments, such lasers might be green lasers, with a transmission wavelength of between about 510-570 nm. One example of such a laser is the model ER60 green laser diode, available from The Laser Guy.com™ of Houston, Tex., which is a 532 nm laser operating at 250 mA and 3.0 VDC, with an output power adjustable from 20 mW to 30 mW. Particular embodiments comprise four lasers, which might be arranged such that a first pair of lasers are generally coaxial but aligned in opposite directions, to generally project two beams along an axis (e.g., the target axis) running through the apparatus; with another pair of lasers that are generally coaxial along an axis (e.g., the ball alignment axis) roughly normal to the target axis. In such embodiments, the beam alignment device might comprise one or more (e.g., four) prisms to focus each beam in the appropriate direction. Such prisms might be cylindrical prisms, triangular prisms, and/or the like. Alternatively, a beam alignment device might simply serve to secure each laser within the housing so as to ensure that the emitted light is projected along the appropriate axes.

Other configurations are possible as well. For instance, in some cases, there may be one laser (or two lasers), perhaps with mirrors, lenses, prisms and/or the like serving as beam alignment devices to project the emitted light along the appropriate axes. In other embodiments, the light emitting device might comprise a single, rotating laser. In such cases, the beam alignment device might comprise a laser housing defining one or more apertures to allow projection of beams along the appropriate axes.

As noted above, some embodiments might project a line, in addition to the target line and the ball position line, that corresponds to the ball's intended flight path to allow the player to align for a draw—in which the ball's flight path curves from right to left for a right-handed player—or fade—in which the ball's flight path curves from left to right for a right-handed player—, while still maintaining the same target axis. In an embodiment, the direction of this line can be adjusted by the user (either manually or electronically through a control circuit) through a variety of angles from the target line (e.g., 5°, 10°, 15°, 20°, 25°, etc.) either by adjustment of the position of the light emitting device, adjustment of the beam alignment device, adjustment of a position of an aperture in a laser housing, etc.

In some embodiments, the control device might comprise a switch, which might be manually manipulable by the user. In certain aspects, the switch might allow selective operation of the device, for example to allow continuous operation of the light emitting devices, to allow intermittent operation of the light emitting devices (e.g., in repeating on-off cycles of varying duration, such as ten seconds on and ten seconds off, etc.), and/or to turn the light emitting devices off altogether. In other embodiments, the control device might comprise one or more accelerometers, which might control operation (e.g., via a switch in the control circuit) of the apparatus through movement, which for example, could allow a user to select a mode of operation (e.g., constant on, intermittent, or off) by moving the apparatus, such as by tapping the apparatus with a foot, club-head, and/or the like. In another aspect, a control circuit featuring such accelerometers could be configured to turn the apparatus off when movement (either directional or angular) greater than a certain threshold is detected; such functionality could provide for safeguards (e.g., to prevent inadvertent exposure of the projected light to the eyes of the user or another) and/or to prevent unintended operation and corresponding battery drain (e.g., if the user were to pick up the apparatus and place it in a golf bag without manually turning it off).

In further embodiments, the control device might comprise a remote control receiver, which could be configured to receive signals (e.g., RF signals) from a supplied remote control device and control operation of the apparatus accordingly. Alternatively and/or additionally, the control device might comprise a receiver (e.g., a Bluetooth receiver, an RF receiver, etc.) configured to receive signals from a separate device (e.g., a wireless phone, handheld computer, remote control device, etc.) running an application for controlling the apparatus. In fact, another set of embodiments provides golf training systems, an example of which might comprise an apparatus as described above, as well as a remote control device and/or a software application executing on a wireless phone (to name one example) for controlling operation of the apparatus.

Another set of embodiments provides methods, including, without limitation, golf training methods. An exemplary method might comprise aligning a golf training apparatus (such as that described above, to name one example) with respect to a target location (e.g., such that the apparatus projects a beam along a target axis that is aligned with the target location), and placing the golf ball on the alignment axis. The method might further comprise the user addressing the golf ball, and/or evaluating the alignment of the user, based at least in part on the position of the user relative to one or more of the beams of light projected by the apparatus. In some cases, the method might further comprise controlling operation of the golf training apparatus using a remote control device and/or a software program on a wireless phone or similar device.

Figure 2:
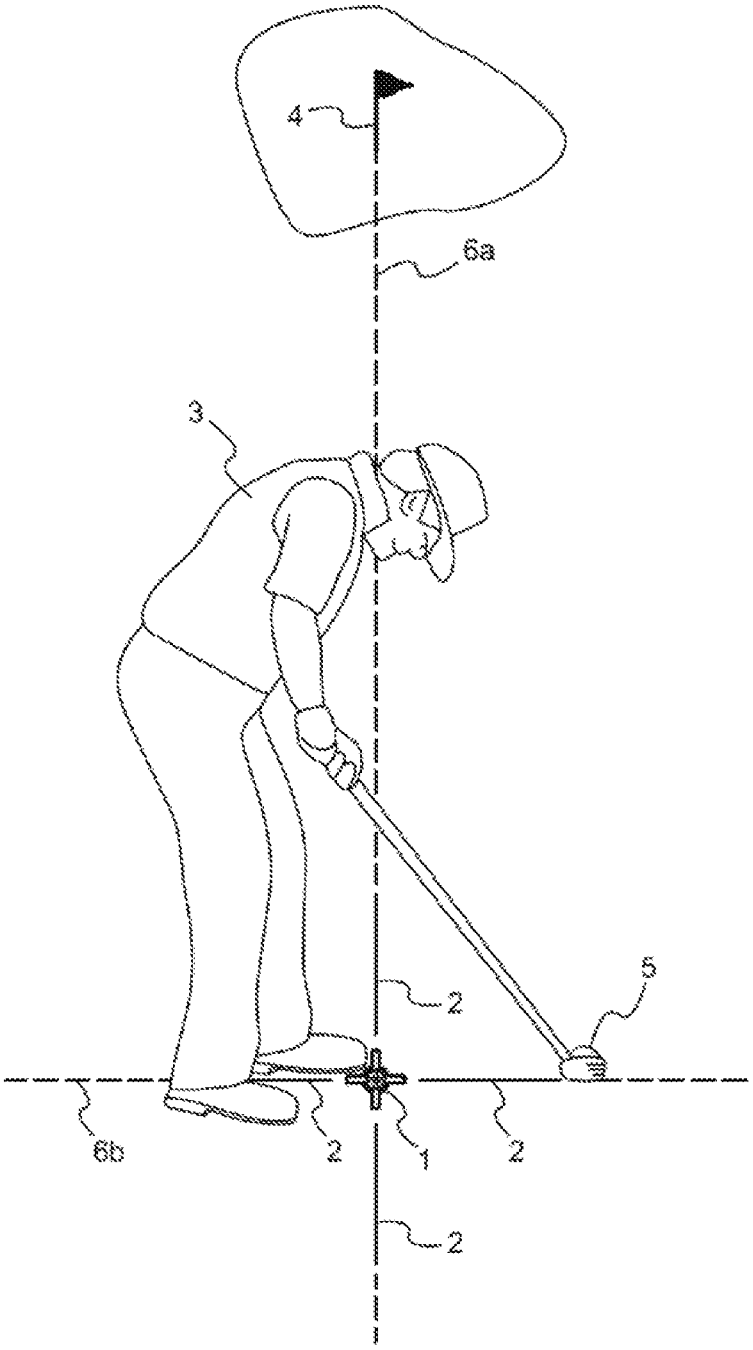
FIG. 2 illustrates an elevation view of a golf training apparatus of a golf training apparatus assisting a golfer's alignment with a target line and a ball, as depicted in FIG. 1.

FIGS. 1 and 2 illustrate one possible use of a golf training device (apparatus) in accordance with a set of embodiments. By reference to both figures simultaneously, the golf training device 1 is configured to project beams 2 of visible light (e.g., laser light) to aid in the alignment of a golfer 3 (also referred to herein as a "player" and a "user"), which is represented in FIG. 1 by footprints 3, with respect to a target location (represented here as the flagstick 4) and the ball 5. The target location 4, of course, represents a point or area to which the player would like to hit the ball 5 by striking the ball 5 with a golf club in a conventional manner.

In the illustrated embodiment, the beams 2 are projected along two axes 6. A first axis (referred to herein as the "target axis" or the "X-axis") 6*a* corresponds to a target line extending from the device 1 to a target 4. Given the distance between the device 1 and the ball 5, compared with the distance between the device 1 and the target 4 (which typically will range from 50-300 yards), the target line between the device 1 and the target 4 is a sufficient approximation of the true target line between the ball 5 and the target 4. A second axis (referred to herein as the "ball alignment axis," the "alignment axis," or the "Y-axis") 6*b* is roughly normal to the target axis 6*a*.

In using the device 1, the player 3 will situate the device 1 so that the X-axis (target axis) 6*a* is aligned with the target 4. Once the player believes he has the apparatus 1 lined up correctly to the target 4, he can power the device 1 on (e.g., using a control device), and optionally take a step back behind the device (along the X-axis 6*a*) to verify that alignment is correct by visually looking at the visible light 2 projected along the X-axis 6*a*. Once alignment is correct, the player 3 will then address to the golf ball 5, using the beam 2, projected along the X-axis 6*a*, to ensure that his feet (and therefore his body) are correctly aligned (e.g., by ensuring that the distance from each foot to the X-axis 6*a* is consistent. Using the beam 2 projected along the Y-axis 6*b* (the ball alignment axis), the user can determine where, in relation to his stance (foot position), the ball 5 lies. For example, for many shots, the player 3 would want the ball 5 to be positioned neutrally between both feet, so that the player 3 would move his feet to ensure that the Y-axis 6*b* falls midway between his feet. In other cases, the player 3 might want to position the ball 5 closer to his lead foot (e.g., when hitting a long iron or a wood), while in other cases, the player 3 might want to position the ball 5 closer to his trailing foot (e.g., when hitting a short iron). In either case, the player 3 can adjust the position of his feet, relative to the Y-axis 6*b* to obtain the correct ball position (while maintaining consistent alignment with the X-axis 6*a*).

Various embodiments can provide other uses and benefits as well. For example, with repeated use of the training device to align shots, players will develop the ability to visualize the proper alignment to the target more precisely even when not using the device. This ability, in turn, creates confidence in the setup, which allows the player to focus on other aspects of the game. Moreover, once a user determines their ideal setup they can learn to change stances for hitting different flight patterned shots.

Additionally, through the use of the device, ball placement within the player's stance will become a much easier process; the player will now have the confidence that he is setting up square (i.e., aligned properly) by reference to the 4 lines being emitted. In certain embodiments, with the device being one solid unit, the location of the target will not play into the use of the device; the player need only point the device at the target, and the player immediately has guidelines on ball position and relationship to stance. Confidence can be built by using the device repeatedly. Better ball position leads to more solid strikes on the golf ball. Ball placement affects every aspect of the swing, for example, if the ball is located too far back in the player's stance, the weight of the player will usually be too far back in his stance, preventing a free swing.

In certain embodiments, clubface position will be addressed when placing the club down on the line towards the ball position. When placing the club head down for address and gripping the club, the user will be able to visually see whether he has their clubface open, closed, or square at address. Various embodiments also allow the player to train hand position at address. When lining up for a shot, the player will be able to visually see if his hands and club handle are in front of, behind, or hovering directly over the line projected between the users stance.

The training device can also be used for putting. Merely by way of example, the device can be placed behind opposite the cup (i.e., on the side of the cup opposite the ball) to direct a beam toward the ball along a putting line. The player then can see the direction and/or type of spin he is producing off his putter, allowing the player to train a more accurate swing plane when putting. Alternatively, as shown in FIGS. 14A-14B below, the device can be placed behind the ball (i.e., with the ball between the device and the cup), the device being elevated so that the beam is between about 5 and about 10 inches from the ground with the beam being angled downward by an angle between 7 and 13 degrees downward. The player then can see the direction and/or type of spin he is producing, while allowing the player to see the line both behind and ahead of the ball's path, allowing the player to train a more accurate swing plane when putting.

Figure 3:
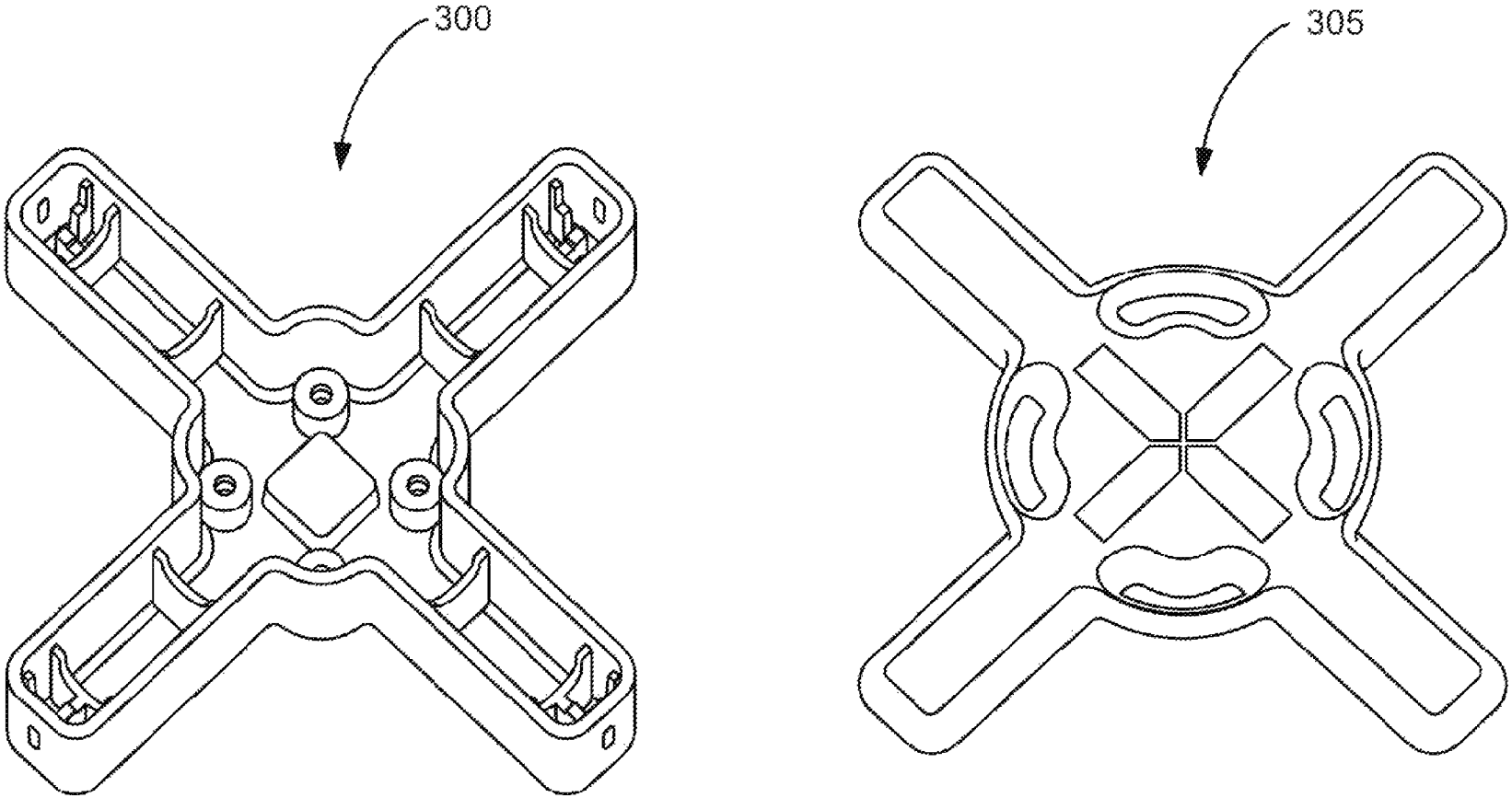
FIG. 3 is a perspective drawing of a golf training apparatus, in accordance with various embodiments.

FIG. 3 illustrates a housing for a golf training device, in accordance with one set of embodiments. The housing comprises a body portion 300 and a lid portion 305, which can be separable to allow for manufacture and/or repair of the device. Housed within the housing typically will be the light emitting devices, the control circuit, a power source (e.g., a battery), and any necessary beam alignment devices.

Figure 4:
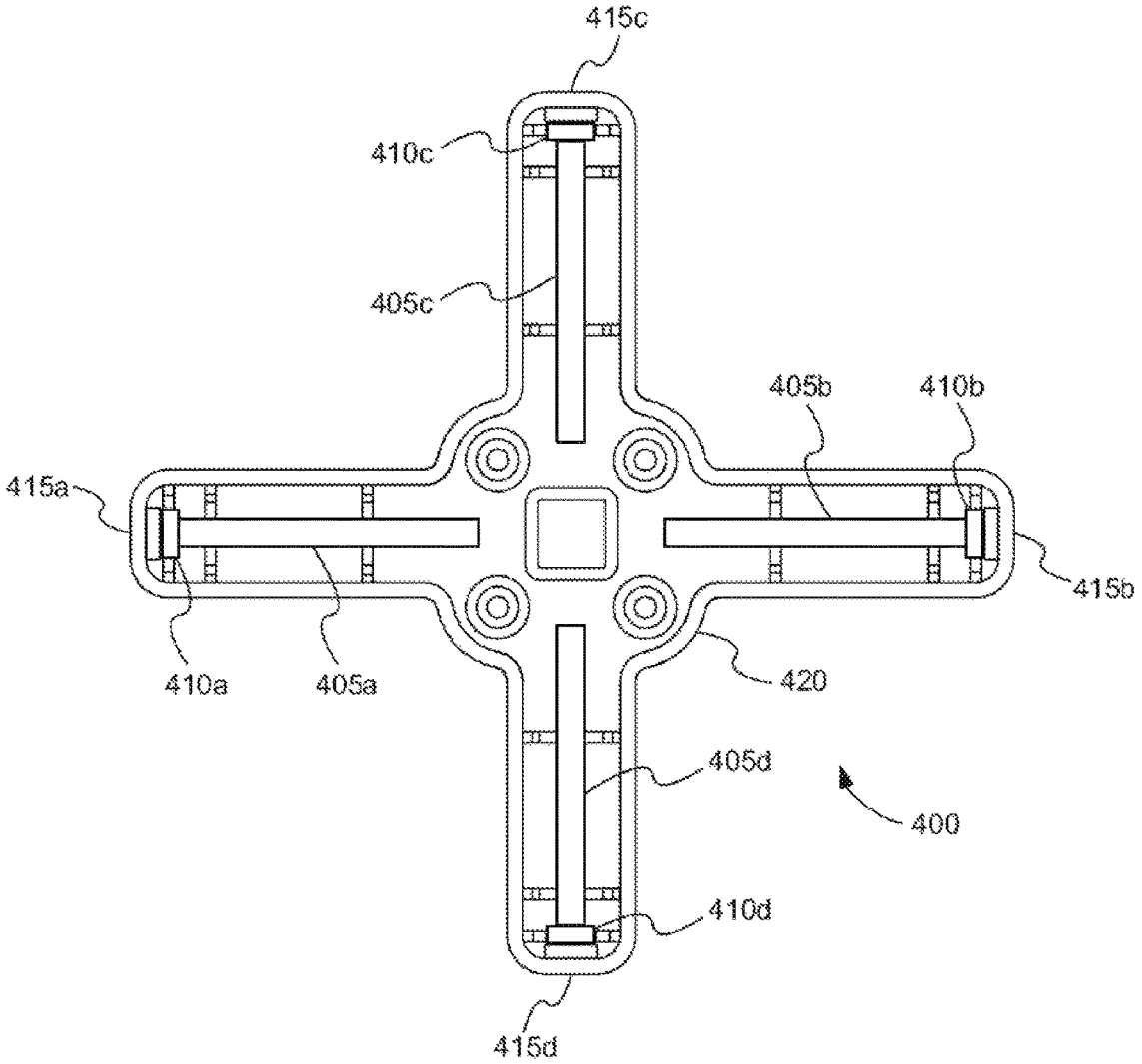
FIG. 4 is a cutaway plan view of a golf training apparatus, in accordance with various embodiments.

FIG. 4 illustrates a cutaway plan view of a golf training device 400. The illustrated device 400 comprises four lasers 405, with four corresponding prisms 410 to align the beams produced by the four lasers 405. (Additionally and/or alternatively, one or more lenses could be used to align the beams produced by the lasers 405. Merely by way of example, in a particular embodiment, the device might employ one or more lenticular lenses to align the beams; for example, the number of lenticules can be selected, based on the characteristics of the laser 405, to optimize laser performance and/or to balance performance with safety and/or regulatory concerns.) The housing 420 defines four apertures 415, through which the beams from the lasers 405 are directed by the prisms 410. One pair of lasers 405*a*, 405*b* are used to generate the beams along the target axis, while the other pair of lasers 405*c*, 405*d* are used to generate the beams along the ball alignment axis.

Various embodiments are configured to provide a variety of beam emission patterns. Merely by way of example, in some embodiments, the beam alignment device (e.g., prism 410*a*, lens, etc.) is situated in relation to the laser 405*a* in such a way that the laser is focused on a point on the ground between about 6 and about 30 inches (and, in certain cases, between about 12 and about 24 inches) from the device 400 (when the device 400 is placed on flat ground). This configuration will produce a visible line extending about the same distance from the device 400. In other cases, the beam alignment device might be configured to project a beam over a longer distance (e.g., several hundred yards), to allow the flight of the ball to be tracked against the target line and/or to allow the target axis to be aligned precisely with the target location. Other configurations are possible as well. For example, in some cases, the device 400 might be configured so that one laser 405*a* projects light a significant distance, while the other three lasers 405*b*, 405*c*, 405*d* project light only between about 6 and about 30 inches from the device.

The housing 420 can be constructed from a variety of materials, including without limitation various plastics and metals. In one embodiment, the housing is molded using WaterShed™ XC 11122 low viscosity liquid photopolymer. The lasers 405, in one embodiment, are 3V-5V green lasers, with power output that is between 1 mW to 60 mW, although other light emitting devices (including other lasers, such as red lasers, and/or light emitting diodes, etc.) can be used as well. The prisms 410 can be, in one embodiment, ¼" diameter cylindrical plastic rods; in other embodiments, they might be fitted plastic or glass lenses, plastic or glass triangular (i.e., pyramidal) prisms. Other beam alignment devices could include 2 to 4 way beam splitters (which might comprise, without limitation, crystals, prisms, mirrors, etc.) and/or plastic or glass lenses (including, without limitation, lenticular lenses, etc.), among other options. The device 400 typically will include other components not illustrated by FIG. 4, including, without limitation, a power source, a control device, and/or a control circuit, and/or the like.

Figure 5A:
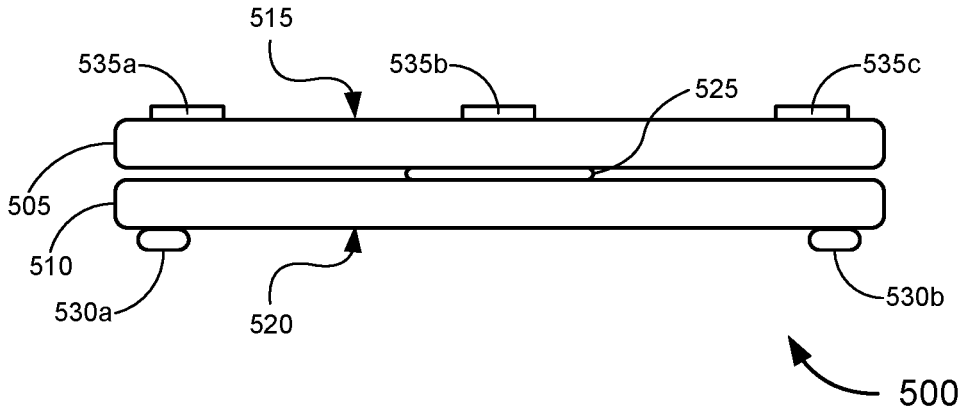
FIGS. 5A-5C illustrate various views of a base for a golf training apparatus, in accordance with various embodiments.
Figure 5B:
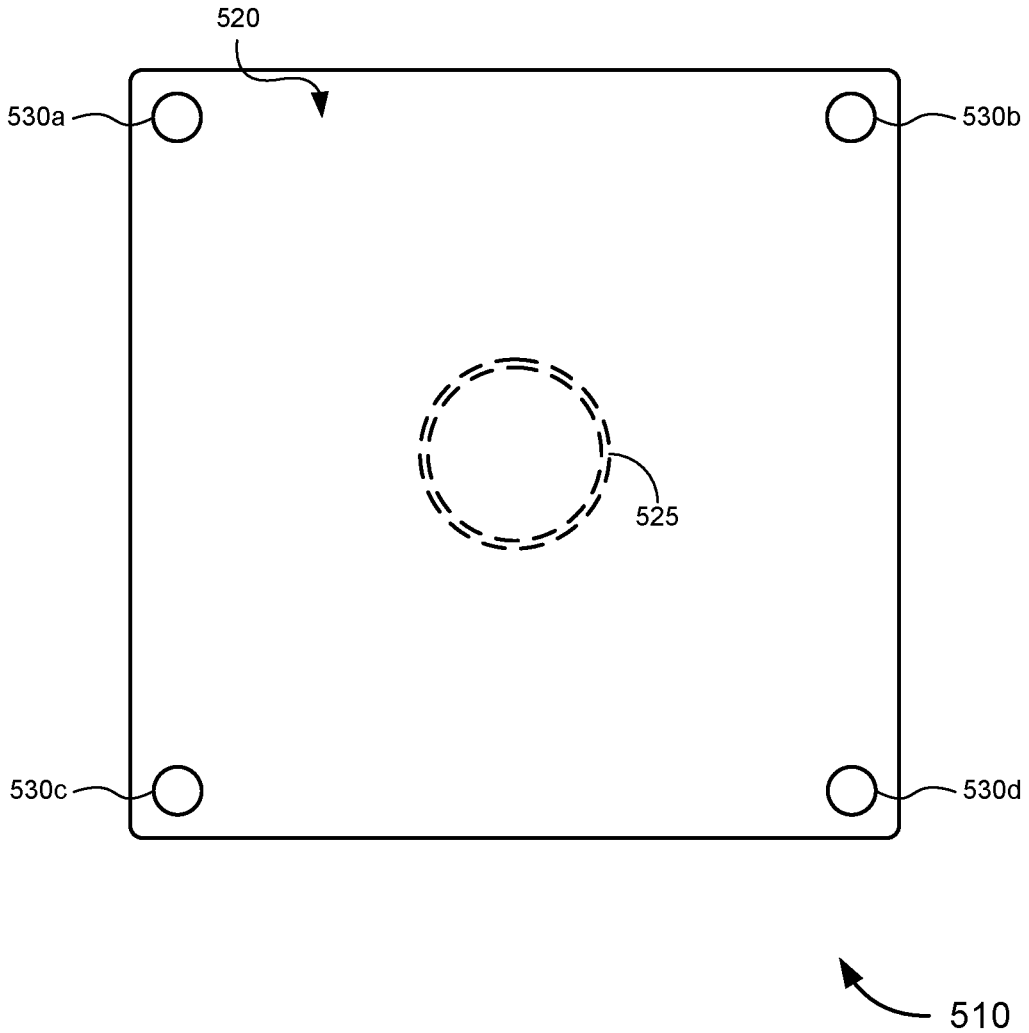
Figure 5C:
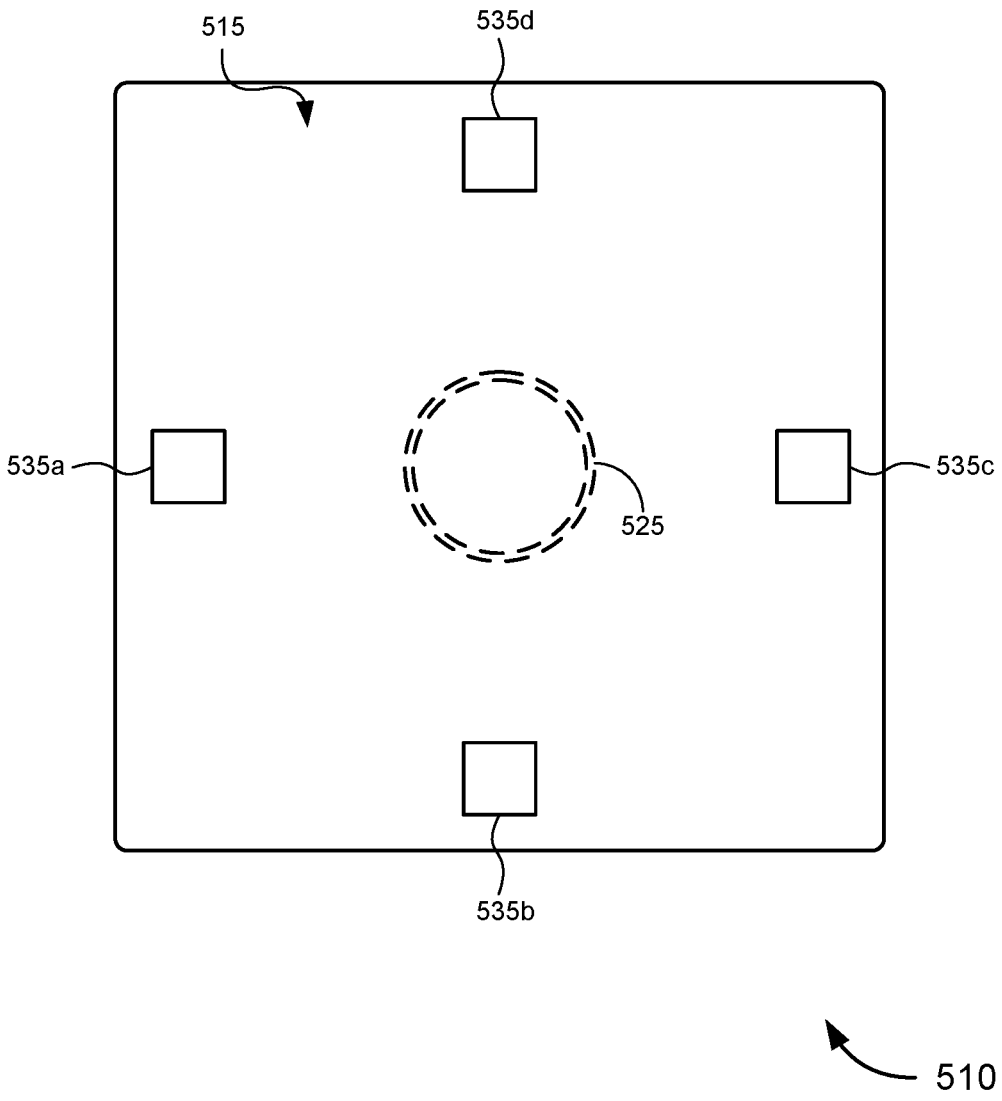

In one set of embodiments, the golf training device might include a base, which can allow the housing of the device to be manipulated with respect to the ground. Merely by way of example, FIG. 5A illustrates an elevation view of a base 500 that can be used in accordance with some embodiments. In some cases, the base might feature a first surface that is configured to be placed on the ground, and a second surface that is configured to have the housing disposed thereon. (In some embodiments, the second surface generally opposes the first surface.) Merely by way of example, the base 500 illustrated by FIG. 5A comprises an upper body 505 (a plan view of which is illustrated by FIG. 5C) and a lower body 510 (a plan view of which is illustrated by FIG. 5B). The lower body 510 comprises a first surface 520 that is configured to be placed on the ground, while the upper body 505 comprises a second surface 515 that is configured to be have the housing of the apparatus (e.g., as illustrated by FIGS. 3 and 4) placed thereon. Although illustrated as being rectangular in FIGS. 5A-5C, the base 500 can take any of a variety of forms or shapes. Merely by way of example, the base 500 might have the same footprint as the housing for the device (e.g., the base 500 might have a similar, cross-shaped footprint as does the housing pictured in FIGS. 3 and 4).

In some instances, the base might include a rotational device, such as a turntable, set of bearings, etc., that allow a portion of the base to rotate along a central axis (which may be normal to the first and/or second surfaces of the base). Merely by way of example, in the illustrated embodiment, the upper body 505 and the lower body are coupled with a rotational coupling apparatus 525 (e.g., with an axle, set of bearings, etc.), such that the second surface 515, on which the housing is disposed, can rotate freely (and/or with resistance, detents, etc.) relative to the first surface 520, effectively allowing the housing to be rotated relative to the ground, without the first surface 520 of the base 500 rotating relative to the ground.

Optionally, the base 500 might comprise bearing surfaces or devices to allow for a more secure fit between the base 500 and the ground and/or between the base 500 and the housing. Merely by way of example, in the illustrated embodiment, the base 500 comprises four legs 530, which can be made of rubber, plastic, or any suitable material. (It should be noted that other embodiments might have more or fewer, or no, legs 530.) In a particular embodiment, the legs 530 might each be attached to the lower surface 520 of the lower body 510 with a threaded attachment, such that each of the legs 530 can be raised or lowered (by threading the legs 530 into the base 500 relatively more or less) to allow the base to sit securely on an uneven ground surface. (Alternatively and/or additionally, the legs 530 might be spiked, to allow for partial insertion into the ground, and the spikes, in some cases, might be incorporated into the lower body 510, etc.)

Similarly, the base 500 might feature one or more coupling mechanisms to allow the base 500 to be coupled with the housing of the golf training device. (As noted above, of course, in some embodiments, the base 500 might be integrated with, and/or permanently attached to, the housing itself) As illustrated by FIGS. 5A and 5C, for example, the upper surface 515 of the upper body 505 includes four coupling mechanisms 535 to allow the base 500 to be coupled with a housing of a golf training device. (It should be noted other embodiments might comprise more or fewer, or no, coupling mechanisms 535.) A wide variety of coupling mechanisms 535 can be used. In some cases, for example, the coupling mechanisms 535 might merely comprise rubber pads that provide friction between the base 500 and the housing. In other embodiments, the coupling mechanisms 535 might employ hook-and-loop fasteners (e.g., Velcro™ fasteners) or other types of fasteners (e.g., Dual Lock™ fasteners), and/or the like. In still other embodiments, the coupling mechanisms might comprise bolts, rivets, or other, more relatively permanent fasteners. In further embodiments, the coupling mechanisms 535 might comprise tabs (or slots, divots, or grooves) that can fit into corresponding slots, divots, or grooves (or tabs) on the bottom surface of the housing. A variety of different coupling devices 535 (and, for that matter, legs 535) can be used in accordance with different embodiments.

In other embodiments, the base might be configured to allow adjustment of an angle of the base of the housing (and/or the upper surface 515) and the ground. This can be accomplished in a number of ways. Merely by way of example, in some cases, the height of the legs 530 might be adjustable (e.g., as described above) to allow the base to rest at an angle to the ground by adjusting some or all of the legs 530 to different heights. In other embodiments, the coupling between the upper body 505 and the lower body 510 might allow for adjustments to allow the upper body 505 and the lower body 510 to be non-coplanar. By changing the angle of the housing (relative to the ground and/or the horizontal), the user then can change the length that one or more of the beams of light will be projected before intersecting the ground.

FIGS. 6A-6D are schematic diagrams illustrating control circuits in accordance with various embodiments. One skilled in the art will appreciate, based on the disclosure herein, that these diagrams are simplified for purposes of illustration and description, and that various embodiments might include various other electrical components, such as resistors, capacitors, diodes, and/or the like, as necessary and/or appropriate.

Figure 6A:
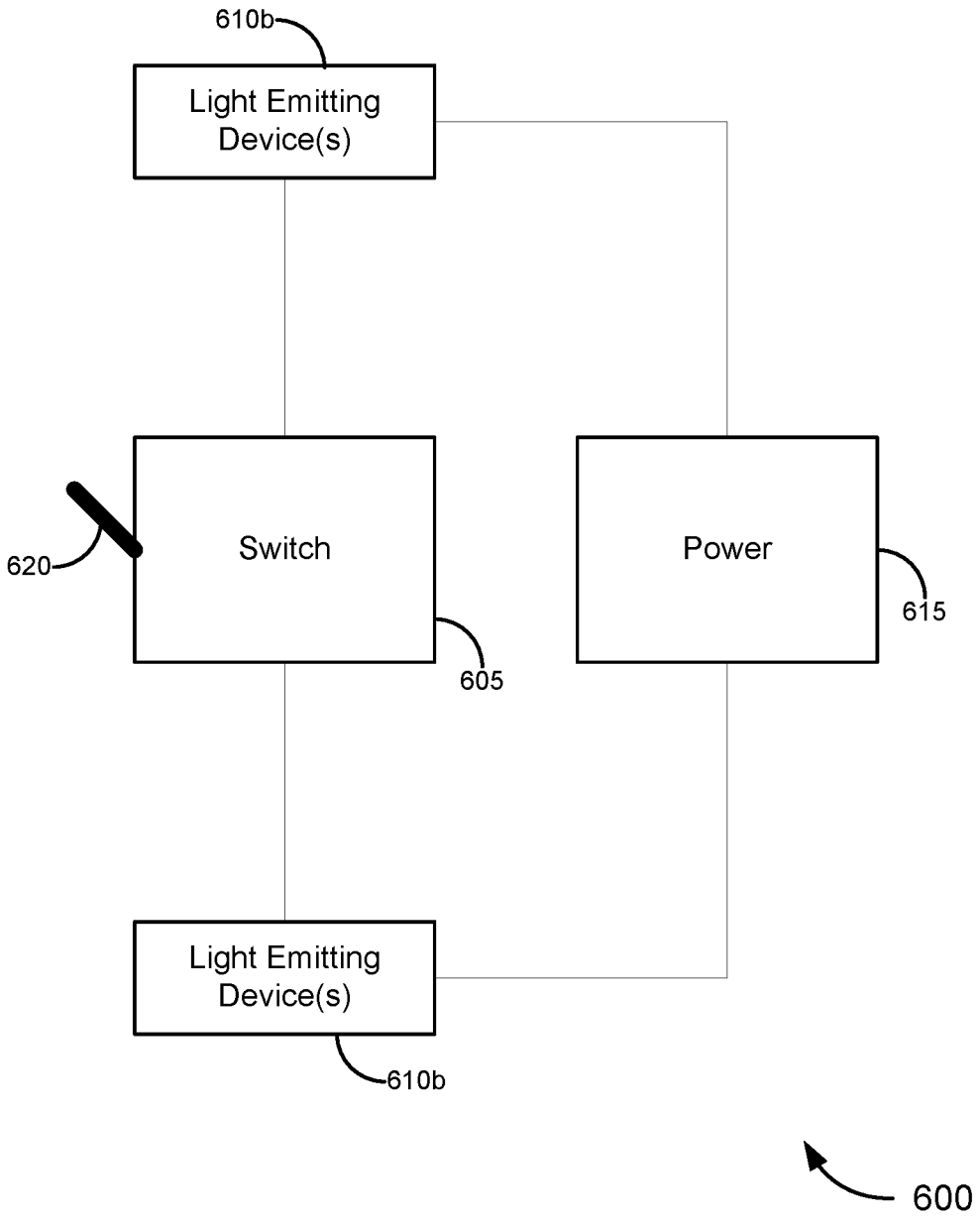
FIGS. 6A, 6B, 6C, and 6D are simplified schematic diagrams of a control circuit for a golf training apparatus, in accordance with various embodiments.

FIG. 6A illustrates a control circuit 600 for controlling operation of a golf training device, such as the devices described above. The control circuit 600 includes a control device (in the illustrated embodiment, switch 605) and two sets of light emitting devices (e.g., lasers, LEDs, etc.) 610, along with a power supply 615. The switch 605 of FIG. 6A includes a toggle 620 that is manipulable by a user. The power supply 615 can include one or more batteries, A/C power (perhaps with an A/C-D/C transformer), and/or the like. In a particular embodiment, power supply 615 might comprise one to four 3V batteries with an amperage range of about 350 to about 2200 mA.

FIG. 6A illustrates the two sets of light emitting devices as being wired in parallel to indicate that either set can be powered on or off independent of the other. In one embodiment, one set of light emitting devices 610*a* might be used to propagate a beam along a target axis, while another set of light emitting devices 610*b* might be used to propagate a beam along a ball alignment axis. Hence, the control circuit 600 can allow the user, for example, to power on the light emitting devices 610*a* to visualize the target line without using the ball alignment feature (or vice versa). It should be noted, of course, that other configurations might be wired in serial or might otherwise require all light emitting devices 610 to be powered on or off together. It should also be recognized that there might be more or fewer than two sets of light emitting devices 610, and that each set might comprise one or more light emitting devices. Merely by way of example, in addition to (or alternative to) two sets of light emitting devices to represent the target axis and ball alignment axis respectively, there might be a third set of one or more light emitting devices to correspond to a ball flight path, as described above.

The switch 605, in certain embodiments can be configured to allow the user to select one or more sets of light emitting devices 610 to be powered on, as well as to specify the operation of the light emitting devices 610 (e.g., constant on, power off, intermittent on, etc.). In one embodiment, the switch 605 might be a 3-position timing switch to allow selection (e.g., via the toggle 620) from among 3 selectable timing positions, such as 30 seconds on, 10 seconds off; 45 seconds on, 10 seconds off; 60 seconds on, 10 seconds off; etc. In some cases, the switch 605 might include a separate toggle 620 for each set of light emitting devices 610.

Figure 6B:
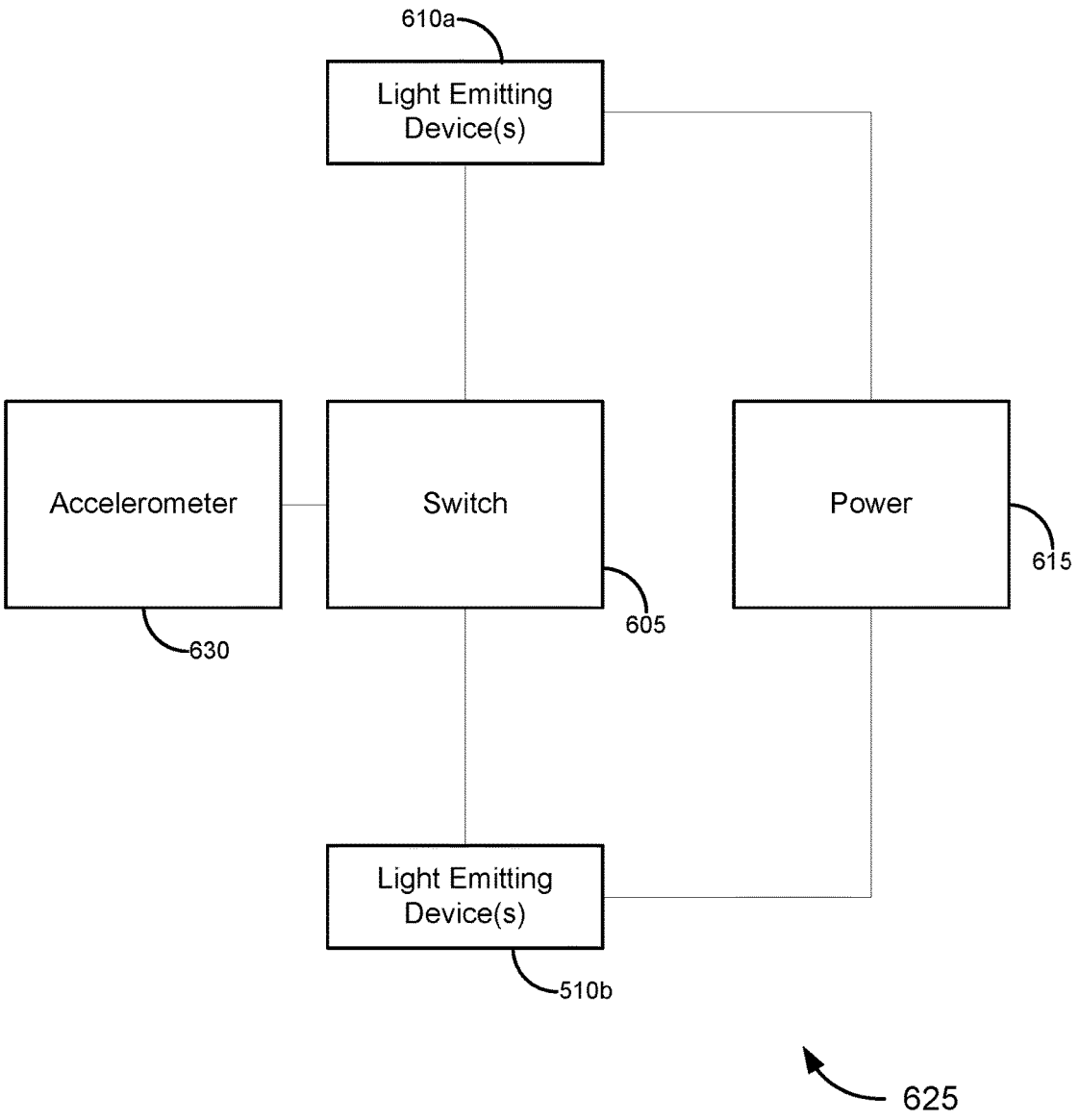

FIG. 6B illustrates a second embodiment of a control circuit 625, which is similar to the control circuit 600 of FIG. 6A, except that the control device comprises a switch 605 in communication with an accelerometer 630. (A toggle switch might be included as well). The control circuit 625 can allow control of the golf training device, as described above, through movement (angular or linear) of the golf training device. Upon sensing movement, the accelerometer 625 transmits a signal to the switch 605 to control operation of the light emitting devices 610.

Figure 6C:
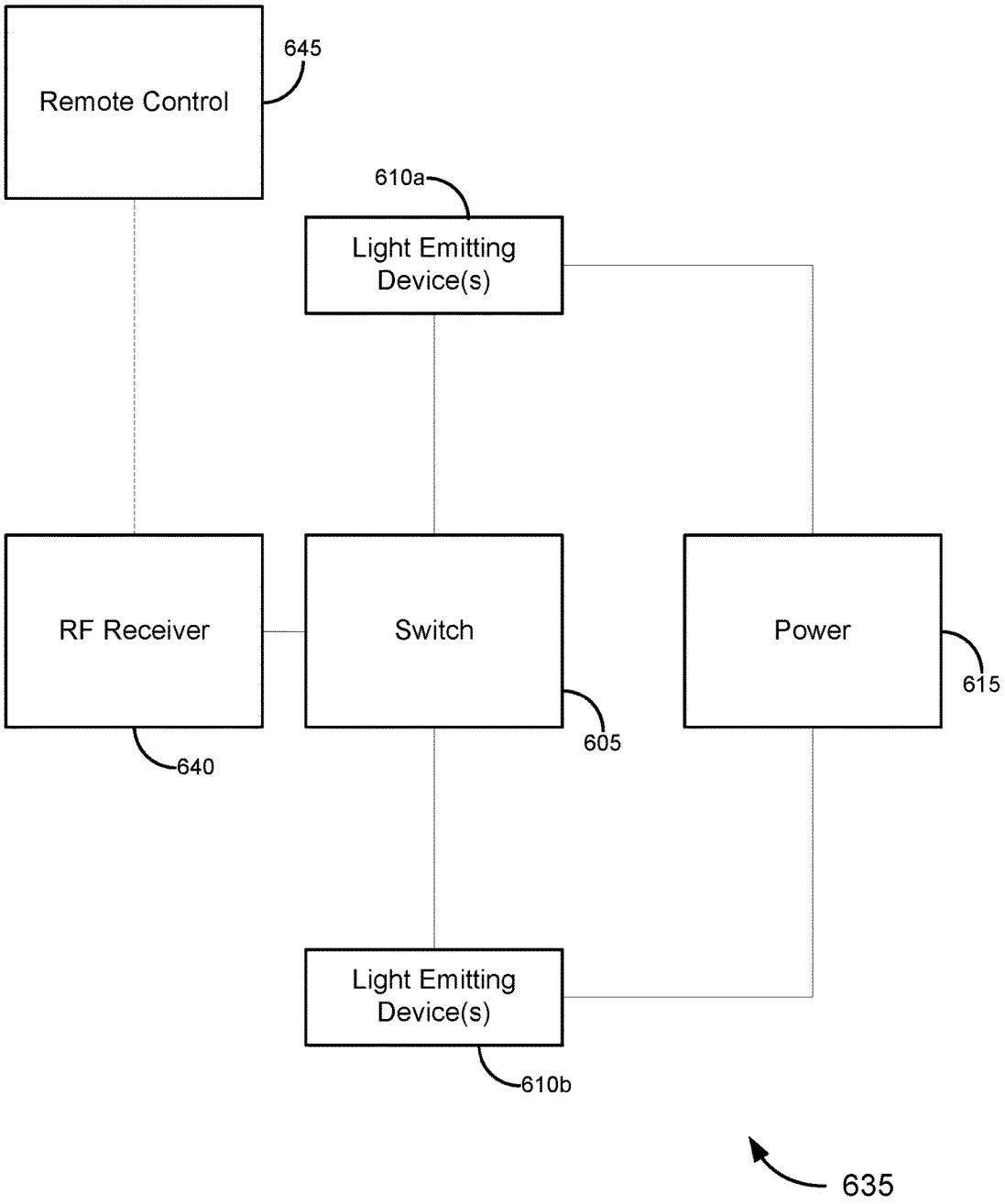

Likewise, FIG. 6C illustrates a third embodiment of a control circuit 635, which is similar to the control circuit 600 of FIG. 6A, except that the control device comprises a switch 605 in communication with an RF receiver 640 that can receive RF signals from a remote control device 645 and thereby, via the switch 605, control operation of the light emitting devices 610. (A toggle switch might be included as well). In other embodiments, the remote control 645 and/or receiver 640 might be configured to operate by infrared transmissions and/or the like.

Figure 6D:
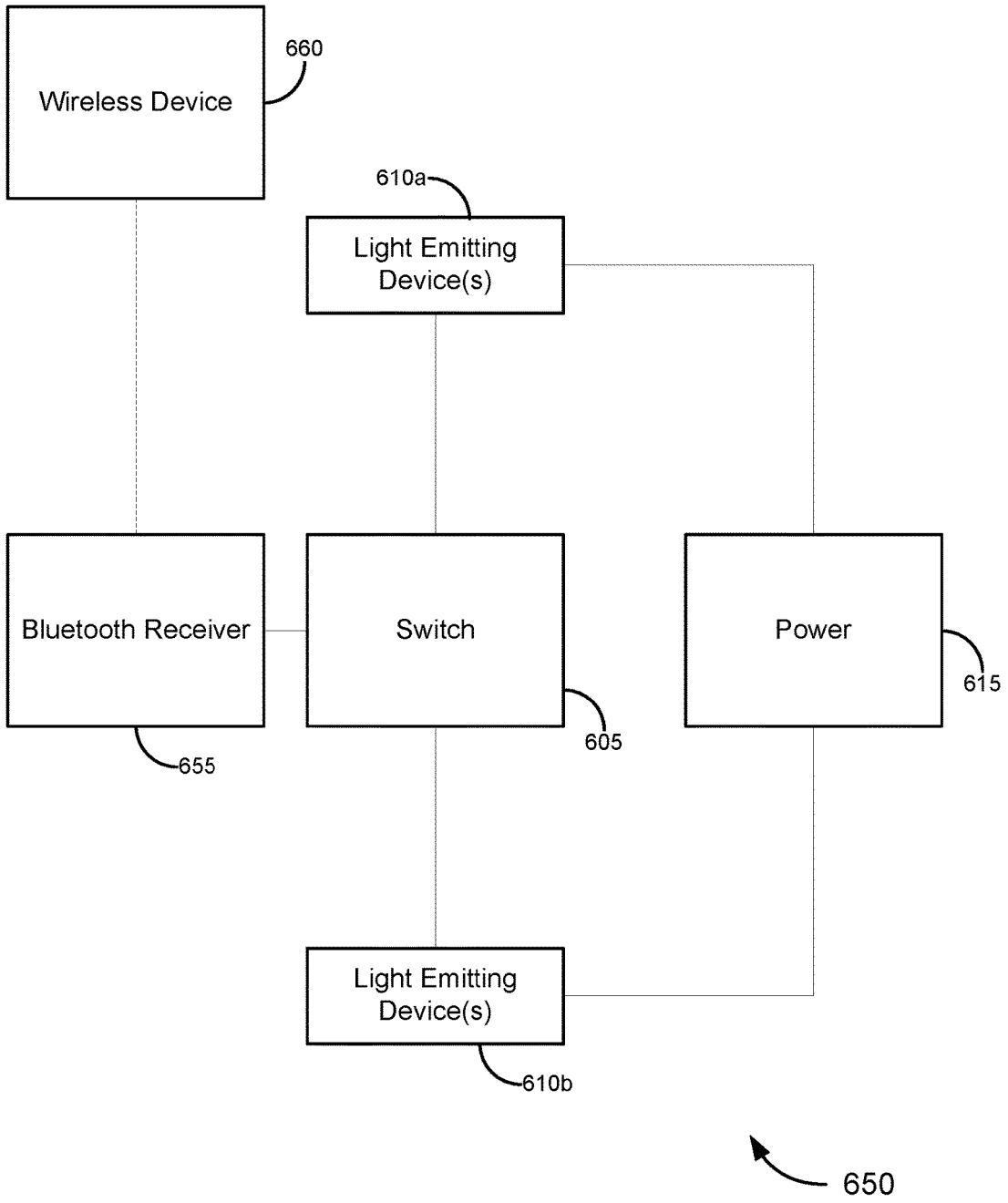

FIG. 6D illustrates a fourth embodiment of a control circuit 650, which is similar to the control circuit 635 of FIG. 6C, except that a Bluetooth receiver 655 can receive signals from a wireless device 660 (e.g., a wireless phone, handheld computer, etc.) and thereby control operation of the light emitting devices 610 via the switch 605. Although not shown, the Bluetooth receiver 655 might be a Bluetooth transceiver that additionally sends information to the wireless device 660, such information include, but not limited to, remaining power (e.g., remaining battery power), low power notifications, switch position status (e.g., indicating which one(s) of the sets of light emitting devices are on or off), and other information (e.g., if the device further comprises gyroscopes or digital/electronic levels, the Bluetooth transceiver might send angular or orientation information to the wireless device 660, etc.), or the like.

It should be appreciated that the components of the control circuits illustrated in FIGS. 6A-6D can be combined as desired (such that, for example, a control device might comprise any combination of a Bluetooth receiver (or transceiver), an accelerometer, an RF receiver, and/or a toggle switch, etc.). In one aspect, a control circuit might be implemented as a printed circuit board ("PCB") programmed for 5 separate power circuits to control up to 5 separate lasers simultaneously, along with control settings for a selectable timing switch, and controls for the accelerometer, remote receivers, etc.

Figure 7:
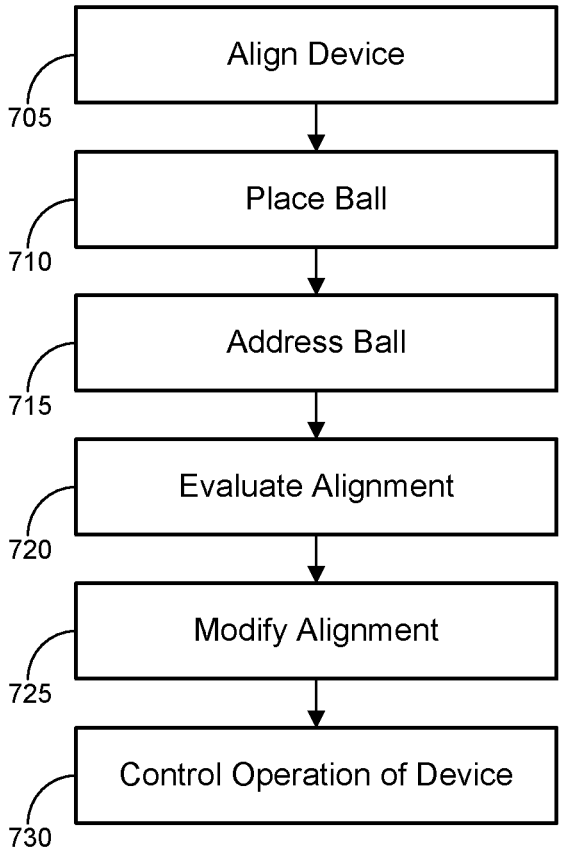
FIG. 7 is a process flow diagram illustrating a method of golf training, in accordance with various embodiments.

FIG. 7 illustrates a method 700 of golf training. At block 705, the method 700 comprises aligning a golf training device (such as the devices described above) with respect to a target location. For example, the golf training device could be aligned so that a beam of emitted light corresponds to a target line to the target location. The method 700 further comprises placing a golf ball on the ball alignment axis of the golf training device (block 710), such that the device emits a beam of light or multiple beams of light that intersect the ball and the player's stance. At block 715, the player addresses the ball in conventional fashion, and at block 720, the method 700 comprises evaluating the player's alignment, based at least in part on the position of the player relative to at least one of the beams of light, for example, in the fashion described above.

In some cases, the method 700 comprises modifying the alignment of the player, based at least in part on the position of the player relative to at least one of the beams of light. Merely by way of example, if the evaluation of the player's stance indicates that the player is not aligned with the target line, the player's feet might be realigned (by movement of one or both feet closer to and/or further from the target axis), and/or if the ball is not aligned in the proper position in the player's stance, the player's alignment might be modified by moving one or both feet either closer to or further from the ball alignment axis.

In particular embodiments, the method 700 can comprise controlling operation of the golf training device (block 730), for example by operating a control device (using, inter alia, any of the methods described above to power on the golf training device (and/or some or all of the light emitting devices therein), to adjust the timing of the light emitting devices, and/or the like. Controlling operation of the golf training device might include, for instance, nudging the device with a foot or clubhead, manipulating a toggle, operating a software program on a wireless phone or other device, and/or operating a remote control device.

Figure 8A:
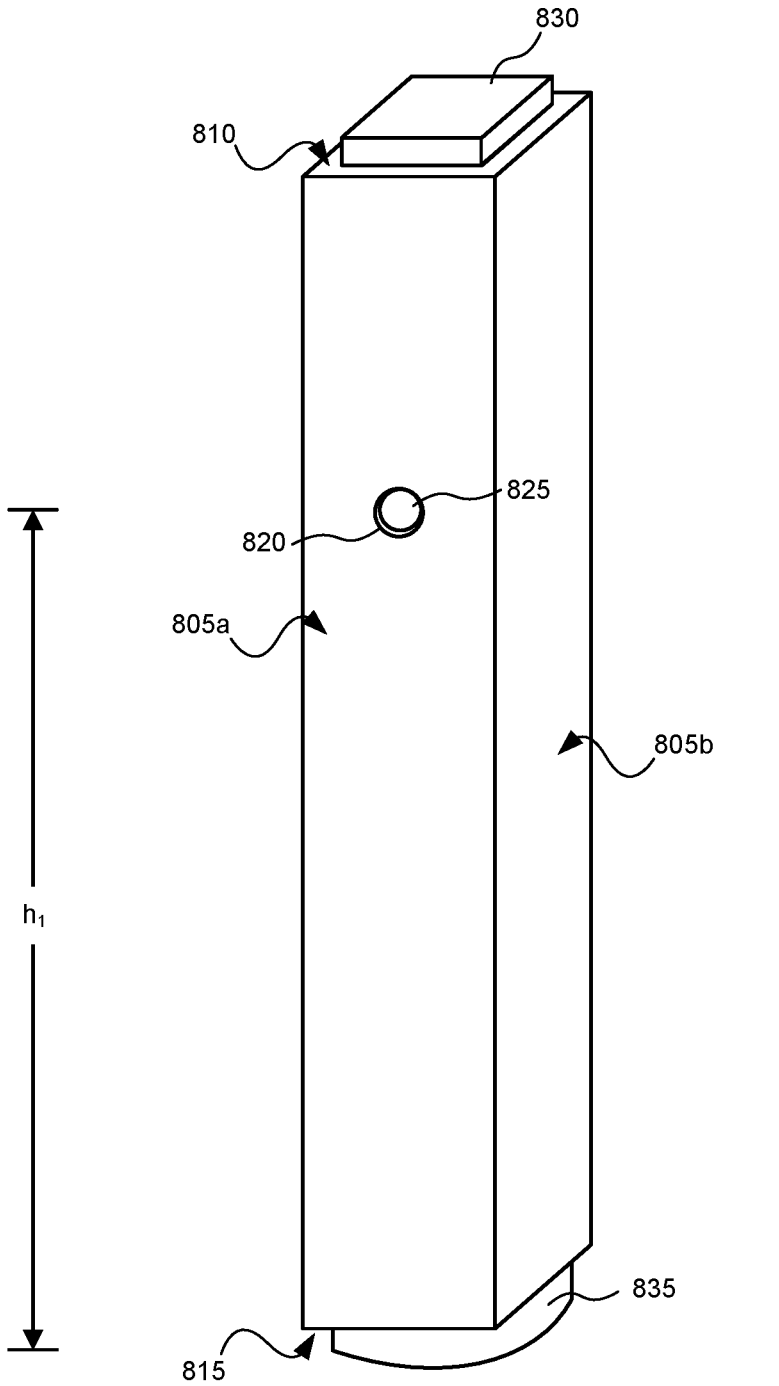
FIGS. 8A-8C illustrate various views of another embodiment of a golf training apparatus.
Figure 8B:
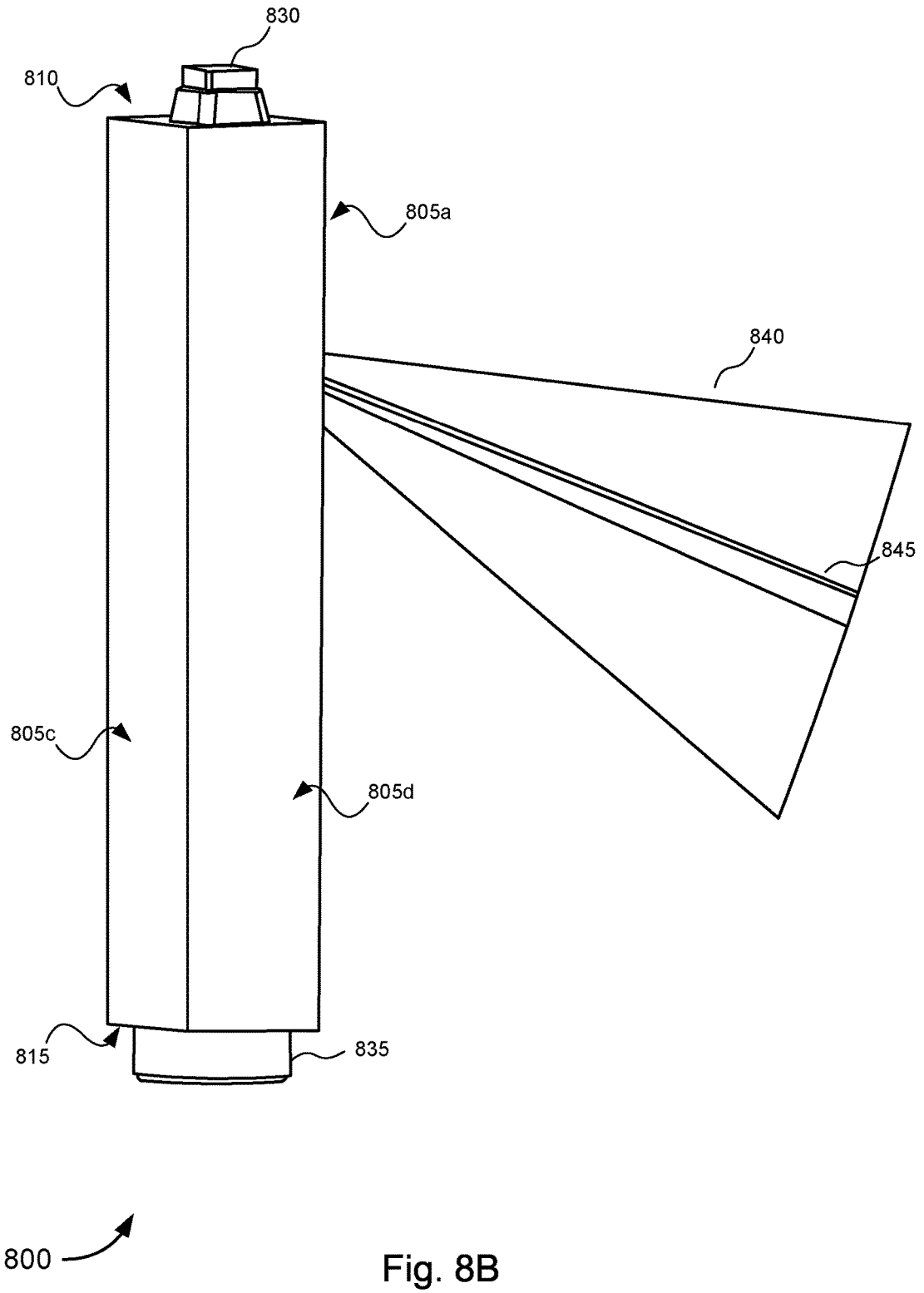
Figure 8C:
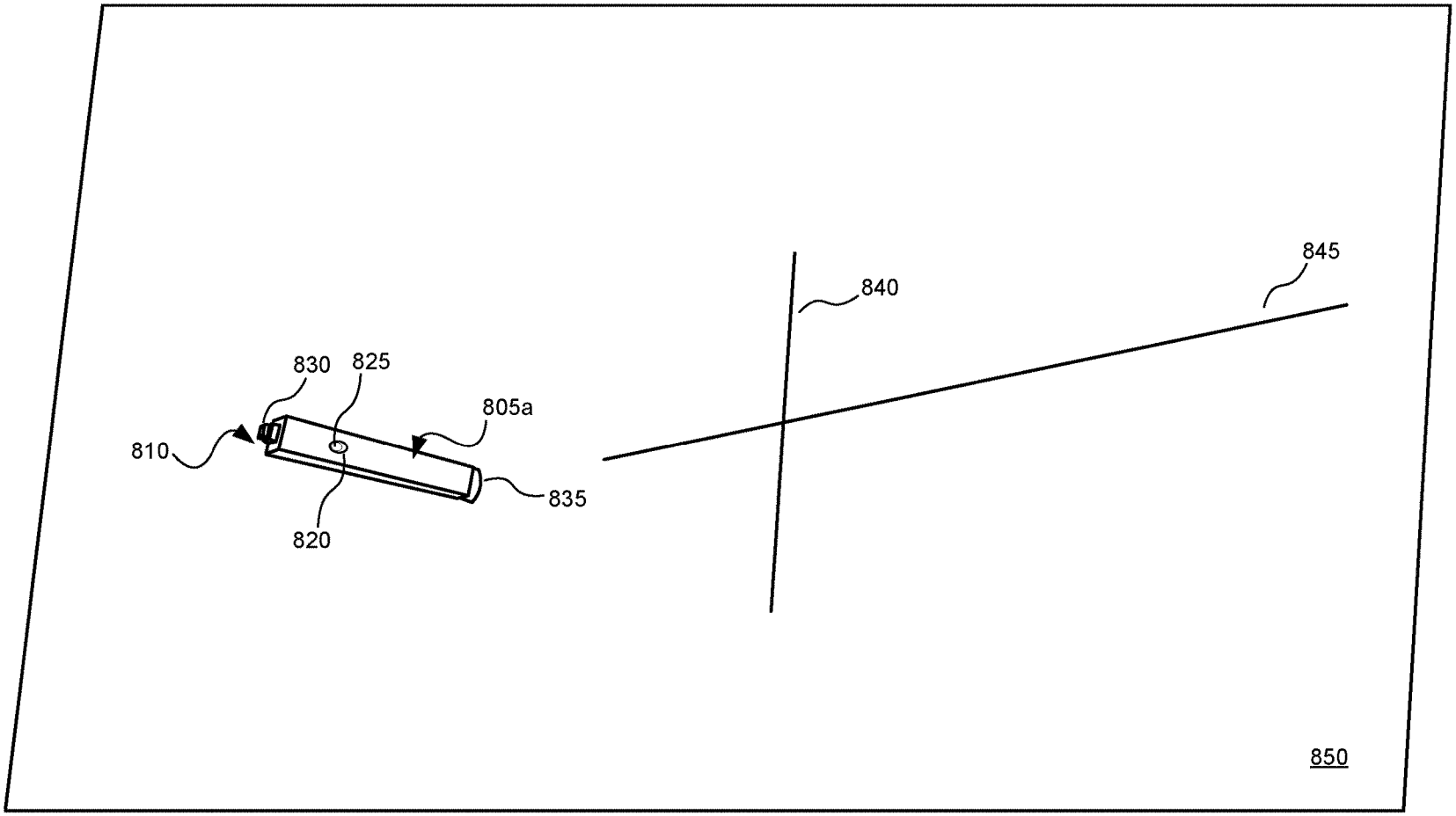

FIGS. 8A-8C (collectively, "FIG. 8") illustrate various views of another embodiment of a golf training apparatus 800. As shown in FIG. 8, golf training apparatus 800 has a shape corresponding to a rectangular prism, with four longitudinal side surfaces 805*a*-805*d* (collectively, "side surfaces 805"), a substantially square (or rectangular) top surface 810, and a substantially square (or rectangular) bottom surface 815. Golf training apparatus 800, in some embodiments, might have a user interface device (or a control device) disposed on at least a portion of the top surface 810. In some cases, the control device or the user interface device of the control device might include, without limitation, at least one of one or more buttons, one or more switches, one or more wireless transceiver ports, one or more Bluetooth transceivers, one or more Infrared transceivers, one or more radio frequency transceivers, one or more microphones, or one or more motion capture devices, and/or the like. According to some embodiments, golf training apparatus 800 might have a base end cap that might interface with the bottom surface 815. In some instances, the base end cap 835 might screw into a counter-threaded hole in the bottom surface 815, and in some cases, might serve as access to a battery receptacle (and perhaps also comprising one of the contacts for the power supply system of the golf training apparatus 800, in a manner that is generally well-known to those skilled in the art. In some instances, the base end cap 835 might also include an interface for removably coupling to a mounting base (some examples of which are shown in and described below with respect to FIGS. 10-13), which might be configured to support the housing 805 of the golf training apparatus 800 in a stable and vertical orientation on a ground surface.

In some embodiments, as shown in FIGS. 8A-8C, golf training apparatus 800 might comprise a housing 805, a single aperture 820 on the first longitudinal side surface 805*a* of the housing 805, one or more lasers (not shown in FIG. 8) disposed within the housing 805 for emitting one or more beams of light within a visible spectrum, and a beam alignment device 825 (a portion of which is shown through the aperture 820 in FIG. 8) disposed within the housing 805. In some cases, the single aperture 820 is disposed on a first longitudinal side surface 805*a* of the four longitudinal side surfaces 805 at a position along the first longitudinal side surface 805*a* that is proximal to the square top surface 810. In some instances, the beam alignment device is configured to direct a first beam of light 840 (e.g., vertical fanning beam as shown in FIG. 8B, which when incident or reflecting off a ground surface 850 is shown as a visible line perpendicular to line 845) and a second beam of light 845 (e.g., horizontal fanning beam as shown in FIG. 8B, which when incident or reflecting off the ground surface 850 is shown as a visible line perpendicular to line 840 and parallel to a direction in which the single aperture 820 is pointing) both through the (same) single aperture 820. In some embodiments, where golf training device 800 is positioned so that the aperture 820 is pointed toward a target (e.g., pin or flag of a hole of a golf course), the first beam of light 840 is directed along a target axis defining an intended target line of a golf ball to be struck by a user and the second beam of light 845 is directed along an alignment axis corresponding to a stationary position of the golf ball relative to a stance of the user. Alternatively, if golf training device 800 is positioned so that the aperture 820 is pointed toward the user, the first beam of light 840 is directed along an alignment axis corresponding to a stationary position of the golf ball relative to a stance of the user and the second beam of light 845 is directed along a target axis defining an intended target line of a golf ball to be struck by a user.

According to some embodiments, the golf training apparatus 800 might further comprise a control device (not shown in FIG. 8) to receive input from the user and a control circuit in electrical communication with at least the one or more lasers and the control device, the control circuit being configured to control operation of the one or more lasers based at least in part on input received by the control device.

In some cases, the single aperture 820 might define one of a circular or an oval shape on the first longitudinal side surface 805*a* of the housing 805. In some instances, the bean alignment device might include at least one of one or more prisms or one or more lenses (e.g., fan angle lens(es), line generator lens(es), and/or the like). According to some embodiments, the height (also referred to herein as "beam height"; as shown in FIG. 8A as height $h_1$) of the single aperture 820 off a ground surface (e.g., ground surface 850 in FIG. 8C) might be between 5 inches (~12.7 cm) and 10 inches (~25.4 cm), between 6 inches (~15.2 cm) and 12 inches (~30.5 cm), preferably 8.5 inches (~21.6 cm) or 9.5 inches (~24.3 cm), or the like.

In some embodiments, rather than a rectangular prism, the shape of the housing 800 might be a cylinder, with a wrapped rectangular surface 805, a circular base surface 815, and a circular top surface 810. The control device might include a user interface device disposed on at least a portion of the circular top surface 810, while the single aperture 820 is disposed on the wrapped rectangular surface 805 at a position along the wrapped rectangular surface 805 that is proximal to the circular top surface 810. As with the rectangular prism embodiment, the single aperture 820 might define one of a circular or an oval shape on the wrapped rectangular surface 805*a* of the housing 805.

The golf training apparatus 800 might otherwise be similar, if not identical to, the golf training apparatus as shown in, and described above with respect to, FIGS. 1-4 and 6.

Figure 9:
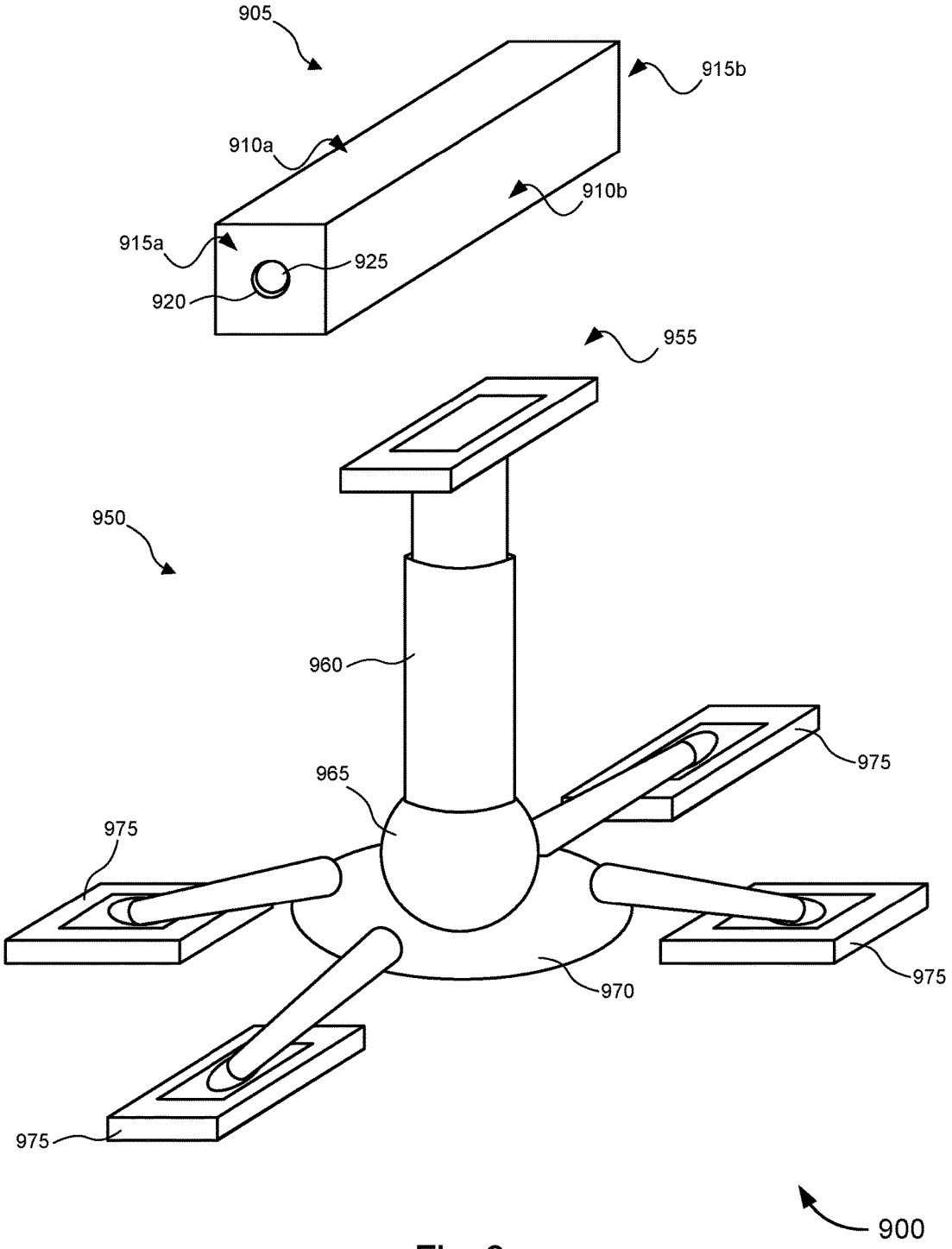
FIG. 9 illustrates a golf training system including a mounting base and yet another embodiment of a golf training apparatus.

FIG. 9 illustrates a golf training system 900 including a mounting base 950 and yet another embodiment of a golf training apparatus 905. In this embodiment, golf training apparatus 905, like golf training apparatus 800 of FIG. 8, might also have a shape of a rectangular prism, except that the apparatus is oriented in the horizontal position, with longitudinal (or rectangular) surfaces 910*a*-910*d* (defining top, bottom, and side surfaces) and two end faces 915*a* and 915*b* at the ends of the longitudinal surfaces 910. An aperture might be disposed on at least one of the end faces 915. The golf training apparatus 900 might further comprise a beam alignment device 925 (a portion of which is shown through the aperture 920 in FIG. 9) that is disposed within the housing. The beam alignment device is configured to direct a first beam of light through the aperture, the first beam of light being directed along a target axis defining an intended target line of a golf ball to be struck by a user, the target axis being parallel, and aligned, with a first axis of the housing. The golf training apparatus 905 might otherwise be similar, if not identical to, the golf training apparatus 800 as shown in, and described above with respect to, FIG. 8.

In some embodiments, the golf training system 900 might further comprise a mounting base 950. In some cases, the mounting base 950 might comprise one or more feet 975 configured to rest on a ground surface, a mounting interface 955 that is configured to removably couple with a corresponding mounting interface (not shown in FIG. 9) of the golf training apparatus 905. In some instances, the mounting interface 955 and/or the corresponding mounting interface might comprise a magnetic interface, a clip-type interface, a screw/thread interface, and/or the like. According to some embodiments, the mounting base 950 might include at least one of a height adjustment system 960 that allows adjustment of the height of the housing of the golf training apparatus relative to the ground surface, a rotation adjustment system 965 that allows the housing to rotate relative to the ground surface, an angle adjustment system 965 (which in the embodiment of FIG. 9 is the same as the rotation adjustment system 965) that allows the housing to be oriented at a variable angle relative to the ground surface, a base portion 970 that couples with one or more of these adjustment systems, and/or the like. Although a particular mounting base is shown in FIG. 9, the various embodiments are not so limited, and any of the mounting bases shown in FIGS. 10-13 may be used to mount golf training apparatus 900.

In the embodiments of FIGS. 10A-10G, 11A-11F, 12A-12E, 13A, and 13B, the golf training apparatus is shown having a general cross shape or plus-sign shape, with a curved interface from each generally rectangular "arm" to an adjacent "arm, via the central connecting portion. The various embodiments, however, are not limited to the cross-shape or plus-sign shape for the golf training apparatus, which can have any suitable shape, including, but not limited to, the rectangular prism of FIGS. 8 and 9, the cylindrical shape as mentioned with reference to (but not shown in) FIG. 8, and the alternative cross shape or plus-sign shape of FIG. 3, and/or the like. When used without the mounting base as described below with respect to these figures, the golf training apparatus may be used in a manner as described above (and shown with respect to) FIGS. 1-4 and 7. When used with the mounting base as described below with respect to these figures, the golf training apparatus may be used for putting (or, in some cases, for chipping).

Figure 10E:
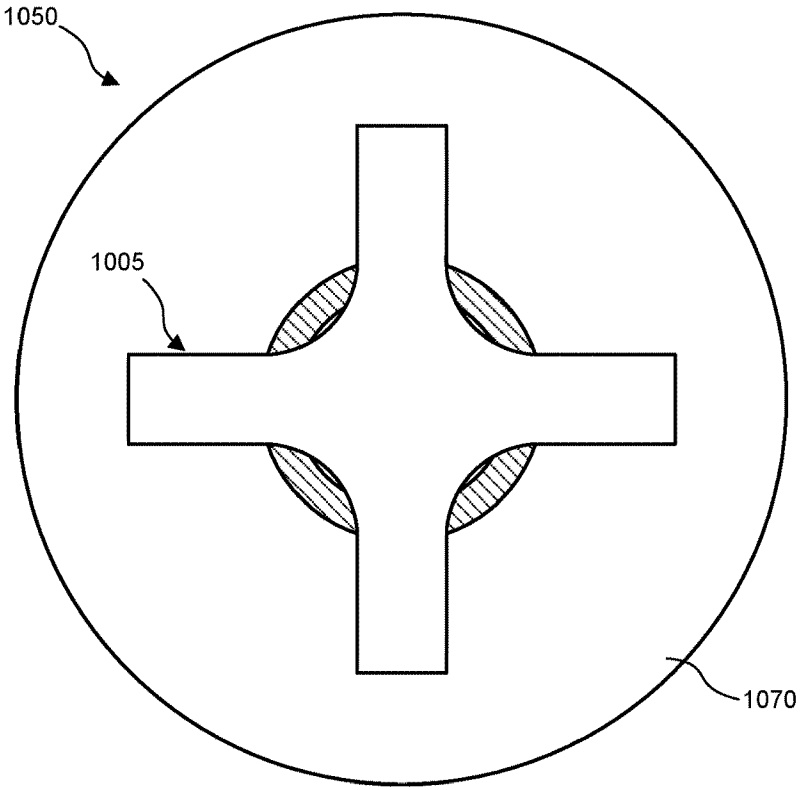
Figure 10D:
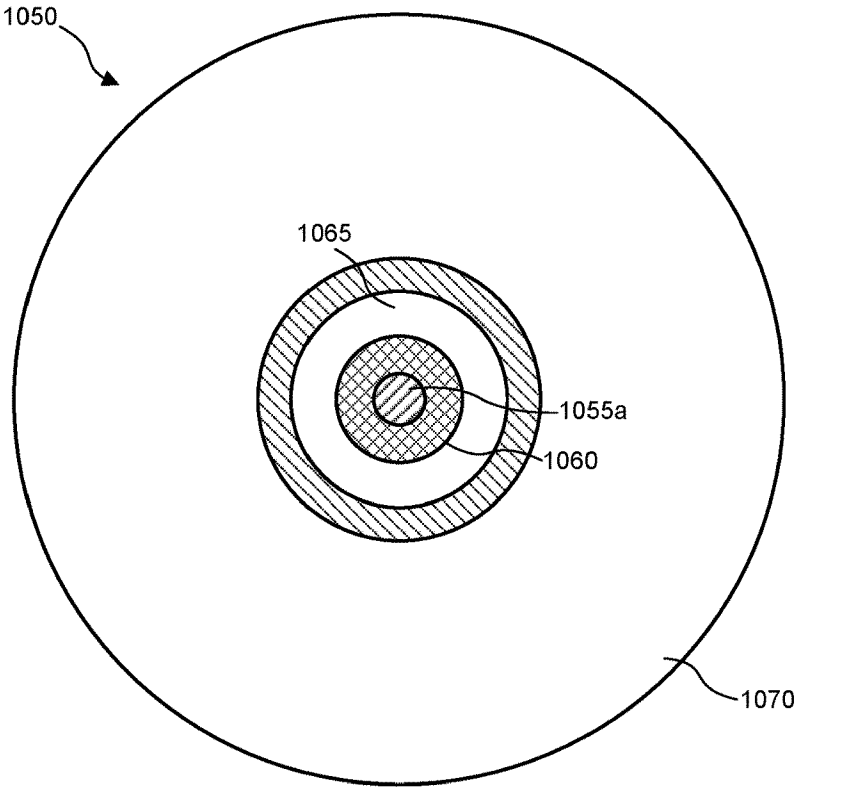

We now turn to FIGS. 10A-10G (collectively, "FIG. 10"), which illustrate various views of another golf training system 1000 including still another embodiment of a golf training apparatus 1005 as well as another embodiment of a mounting base 1050. In FIGS. 10A-10C, golf training system 1000 might comprise a golf training apparatus 1005, which might have a general cross shape or general plus-sign shape, with four arms having general rectangular prism shape and a central portion that connects the four arms, the central portion having curved sides that provide a curved or rounded or concave interface between adjacent arms. The top surface 1010*a* is shown in FIG. 10B, as viewed along the A-A direction of FIG. 10A, while the bottom surface 1010*b* is shown in FIG. 10C, as viewed along the B-B direction of FIG. 10A. At the end of each arm is an end face 1015, with the first arm having a first end face 1015*a*, the second arm having a second end face 1015*b*, the third arm having a third end face 1015*c*, and the fourth arm having a fourth end face 1015*d*. An aperture 1020 is disposed on at least the first end face 1015*a* (and, in some cases, also on the second end face 1015*b*, which is opposite (i.e., along the same axis) the first end face 1015*a*; and in yet other cases, also on each of the third and fourth end faces 1015*c* and 1015*d* (which are on the axis perpendicular to the axis defined by the first and second arms)). Within the aperture (or through the aperture) is disposed a beam alignment device 1025, which aligns one or more beams of light emitted by one or more light emitting devices or lasers (not shown in FIG. 10) that are housed in at least a portion of one or more of the arms.

In some cases, each arm houses a set of one or more light emitting devices or lasers for emitting one or more beams of light through the beam alignment device 1025 disposed in the end face 1015 of that particular arm. In other cases, a set of one or more light emitting devices or lasers is used to emit two or more beams of light through multiple beam alignment devices 1025 in two or more of the end faces 1015, via any appropriate combination of one or more of mirrors, beam splitters, prisms, lenses, etc. Also shown in FIG. 10C, the golf training apparatus 1005 further comprises a mount interface 1030 on a portion of the bottom surface 1010*b*. In the embodiment of FIG. 10, the mount interface 1030 is a threaded hole through which a threaded rod of a mounting base may be removably inserted. Other embodiments provide for different types of mount interfaces, as desired or as required.

Figure 10F:
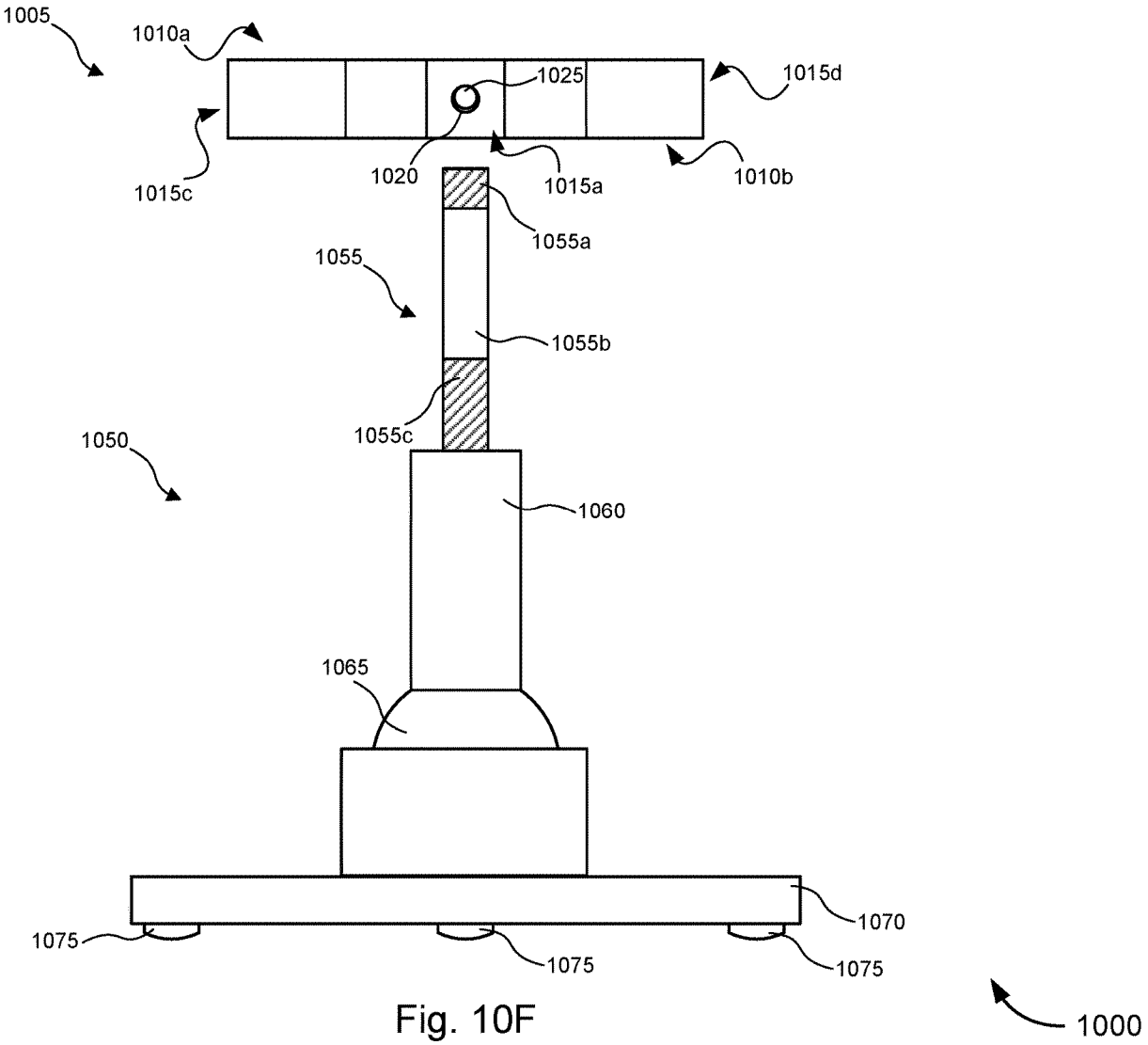
Figure 10G:
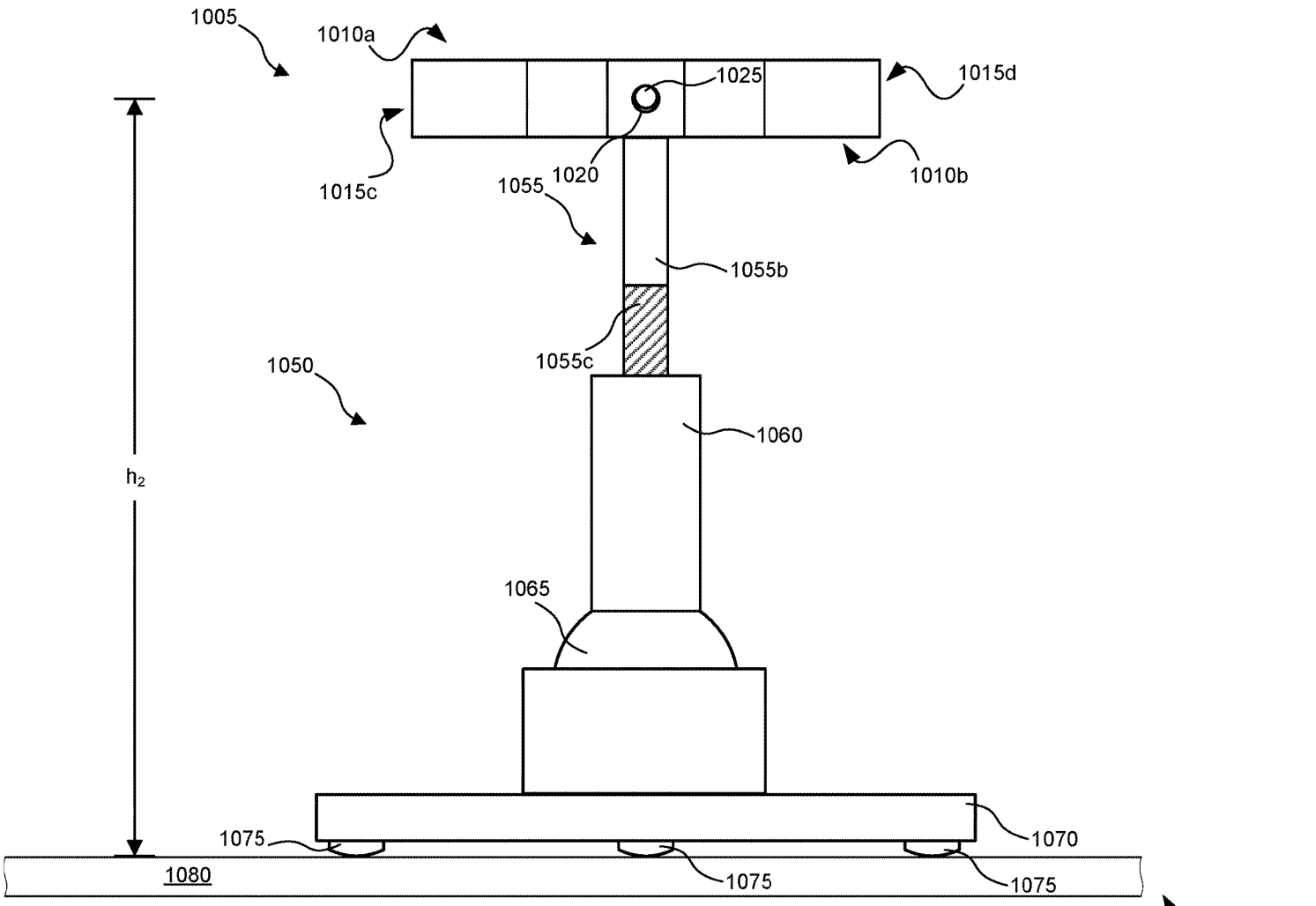

FIGS. 10D-10G depict a mounting base 1050 to which the golf training apparatus 1005 may be mounted to raise the golf training apparatus 1005 off the ground surface by a desired height (e.g., height $h_2$ as shown in FIG. 10G). In some embodiments, the height of the golf training apparatus 1005 can be adjusted using a height adjustment system (if any) of the mounting base 1050. In some instances, the height (also referred to herein as "beam height") of the aperture 1020 off a ground surface (e.g., ground surface 1080 in FIG. 10G) might be between 5 inches (~12.7 cm) and 10 inches (~25.4 cm), between 6 inches (~15.2 cm) and 12 inches (~30.5 cm), preferably 8.5 inches (~21.6 cm) or 9.5 inches (~24.3 cm), or the like. According to some embodiments, the mounting base might alternatively, or additionally, comprise a rotational adjustment system for allowing the golf training apparatus to be rotated relative to a ground surface (or relative to a base portion or feet of the mounting base), an angular tilt adjustment system for allowing the golf training apparatus to be oriented at a variable angle relative to the ground surface (or relative to the base portion or feet of the mounting base), or a combination rotation/tilt adjustment system that allows for both rotation and tilt with respect to the ground surface (or with respect to the base portion or feet of the mounting base).

In the embodiment of FIG. 10, the mounting base 1050 might comprise a base portion 1070 (which might, in some embodiments be shaped as a disk, with or without feet 1075 on a bottom surface thereof), a combination rotation/tilt adjustment system 1065 disposed on (or integrated with) the top surface of the base portion 1070, and a height adjustment system 1060. According to some embodiments, the combination rotation/tilt adjustment system 1065 might comprise a first cylinder, on a top surface of which is disposed a concave opening that is configured to removably couple with at least a portion of a spherical object, which is part of the combination rotation/tilt adjustment system 1065. The height adjustment system 1060 might comprise a second cylinder (which may have a diameter smaller than the diameter of the first cylinder). The second cylinder might be integrated with the at least a portion of the spherical object (collectively, "articulated arm"). The articulated arm, when coupled with the first cylinder, can rotate relative to the first cylinder and can tilt relative to the first cylinder (independent of the rotation). Within the top surface of the second cylinder might be disposed a threaded interface similar to the threaded cylinder of the mount interface 1030. A rod 1055 either having threading throughout its length (not shown) or having threading at a first end 1055*a* and at a second end 1055*c*, without threading in a middle portion

1055*b* (as shown in FIGS. 10F and 10G) may be used to interface the golf training apparatus 1005 with the mounting base 1050, by inserting the threaded ends 1055*a* and 1055*c* of the rod 1055 into the threaded holes of each of the golf training apparatus 1005 and the mounting base 1050.

Figure 13A:
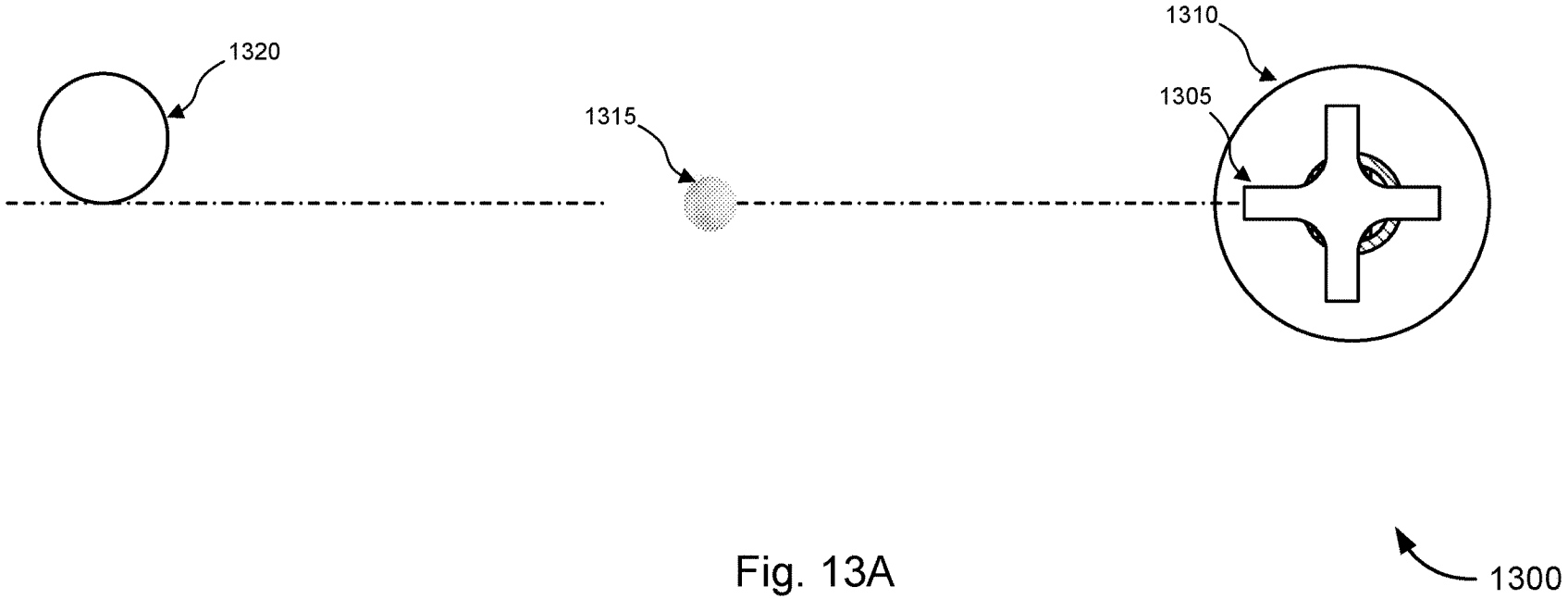
FIGS. 13A and 13B illustrate various plan views of a golf training system assisting a golfer's alignment with a target line, a ball, and a cup or hole cut into the green, in accordance with various embodiments.
Figure 13B:
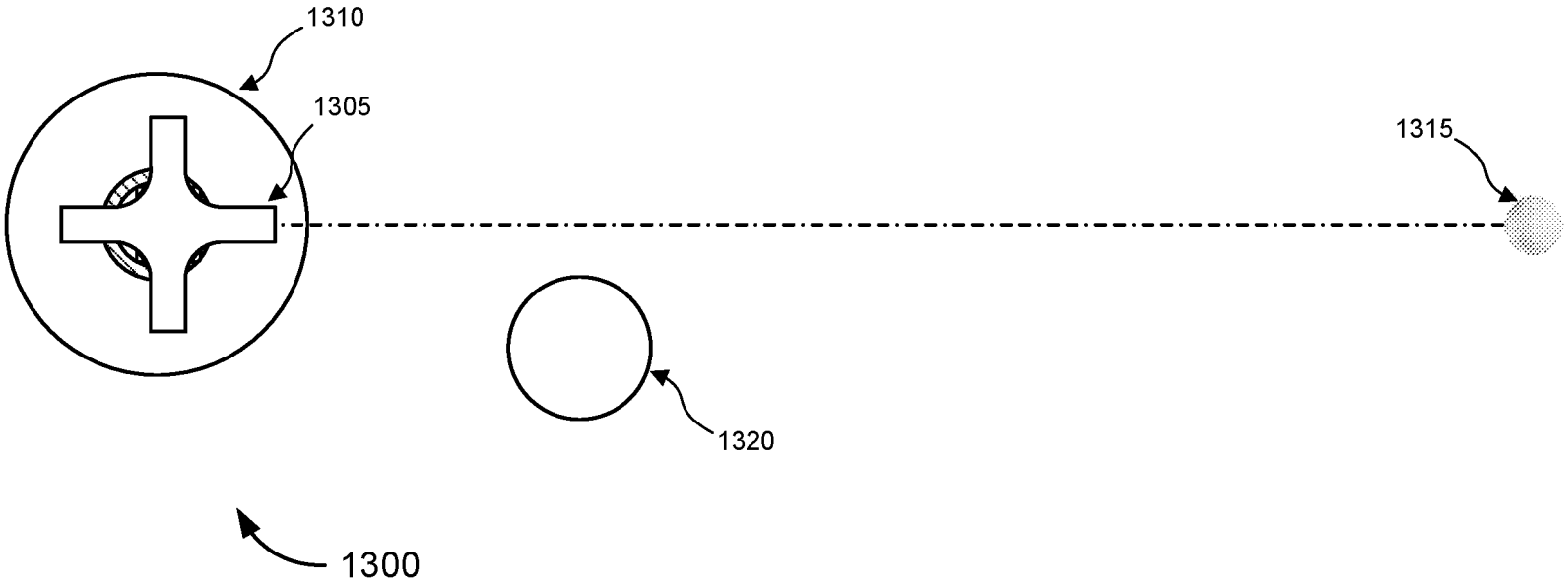

In use, the golf training system 1000 is placed either behind the ball (i.e., behind the intended direction of travel of the golf ball, as shown in the embodiment of FIG. 13A) or in front of the ball (i.e., in the general direction toward which the golf ball is intended to travel, typically in proximity or behind the cup or hole disposed in the green or putting area, as shown in the embodiment of FIG. 13B). When behind the ball, the height of the golf training system 1000 (particularly, the height of the top surface 1010*a* of the golf training apparatus 1005 that is mounted to the mounting base 1050) should, in some cases, be no higher than about 10 inches (or ~25.4 cm) from the ground surface, which would allow for an appropriate brightness of the beam of light (i.e., so as to be visible to the user or player), without being in the way of the user's swing of his or her club (e.g., wedge, etc.) or putter. In some embodiments, the golf training system 1000 might be positioned about 16 to about 24 inches (~40.6 to ~61.0 cm) from the ball. Any closer does not allow for a full or proper back swing, while any further might result in a brightness of the beam of light being so low as to be difficult for the user to see. According to some embodiments, the beam alignment device(s) 1025 might be positioned, oriented, or configured to emit the beam(s) of light at a downward angle (from the horizontal or from the plane defined by the arms of the golf training apparatus 1005) of between about 5 and about 20 degrees, preferably between about 7 and about 13 degrees. In some embodiments, the tilt adjustment system 1065 (or the combination rotation/tilt adjustment system 1065) might be tilted at the desired tilt angle. In some cases, the tilt adjustment system 1065 (or the combination rotation/tilt adjustment system 1065) might include markings at the appropriate angles or at graduated angles to allow the user to orient the system at the desired angles. Likewise, the height adjustment system 1060 might include markings at appropriate heights or at graduated heights to allow the user to configure the system at the desired heights. In some instances, the beam alignment device(s) 1025 might alternatively or additionally provide a fan angle of 12 degrees, 15 degrees, 22 degrees, or 30 degrees, with the larger fan angles producing a longer line for any particular height of the system 1000.

The golf training apparatus 1005 might otherwise be similar, if not identical to, the golf training apparatus 800 or 905 as shown in, and described above with respect to, FIG. 8 or 9, respectively. Likewise, golf training system 1000 might otherwise be similar, if not identical to, the golf training system 900 as shown in, and described above with respect to, FIG. 9.

FIGS. 11A-11F (collectively, "FIG. 11") illustrate various views of yet another golf training system 1100 including another embodiment of a golf training apparatus 1105 as well as yet another embodiment of a mounting base 1150. In FIGS. 11A-11F, golf training system 1100 might comprise a golf training apparatus 1105, which might have a general cross shape or general plus-sign shape, with four arms having general rectangular prism shape and a central portion that connects the four arms, the central portion having curved sides that provide a curved or rounded or concave interface between adjacent arms. Golf training apparatus 1105 comprises a top surface 1110*a* and a bottom surface 1110*b*. At the end of each arm is an end face 1115, with the first arm having a first end face 1115*a*, the second arm having a second end face 1115*b*, the third arm having a third end face 1115*c*, and the fourth arm having a fourth end face 1115*d*. An aperture 1120 is disposed on at least the first end face 1115*a* (and, in some cases, also on the second end face 1115*b*, which is opposite (i.e., along the same axis) the first end face 1115*a*; and in yet other cases, also on each of the third and fourth end faces 1115*c* and 1115*d* (which are on the axis perpendicular to the axis defined by the first and second arms)). Within the aperture (or through the aperture) is disposed a beam alignment device 1125, which aligns one or more beams of light emitted by one or more light emitting devices or lasers (not shown in FIG. 11) that are housed in at least a portion of one or more of the arms.

In some cases, each arm houses a set of one or more light emitting devices or lasers for emitting one or more beams of light through the beam alignment device 1125 disposed in the end face 1115 of that particular arm. In other cases, a set of one or more light emitting devices or lasers is used to emit two or more beams of light through multiple beam alignment devices 1125 in two or more of the end faces 1115, via any appropriate combination of one or more of mirrors, beam splitters, prisms, lenses, etc. Also shown in FIG. 11D, the golf training apparatus 1105 further comprises a mount interface 1130 on a portion of the bottom surface 1110*b*. In the embodiment of FIG. 11, the mount interface 1130 is a threaded hole through which a threaded rod of a mounting base may be removably inserted. Other embodiments provide for different types of mount interfaces, as desired or as required.

Golf training apparatus 1105 is similar to golf training apparatus 1005 of FIG. 10, except that golf training apparatus 1105 further comprises a plurality of interlock devices 1130, in some cases, disposed on the bottom surface 1110*b* of the golf training apparatus 1005. In some embodiments, the plurality of interlock devices 1130 might comprise a first interlock device 1130*a* disposed on the bottom surface of the first arm, a second interlock device 1130*b* disposed on the bottom surface of the second arm, a third interlock device 1130*c* disposed on the bottom surface of the third arm, and a fourth interlock device 1130*d* disposed on the bottom surface of the fourth arm, each of the first through fourth interlock devices 1130*a* through 1130*d* being configured to close a circuit with a corresponding light emitting device or laser for the particular arm when depressed or engaged (e.g., when the individual interlock device 1130 is pushed into the housing of the golf training apparatus 1105 or when the golf training apparatus 1105 is resting on the ground surface) thereby allowing the light emitting device or laser for the particular arm to emit the beam of light, while being configured to open said circuit when not depressed or not engaged, thereby preventing the light emitting device or laser for the particular arm from emitting the beam of light (to ensure that the beam of light does not accidentally shine into the eyes of the user or of persons nearby). In some embodiments, golf training apparatus 1105 might further comprise a fifth interlock 1130*e* on a bottom surface of the first arm (in some cases, near or in proximity to the first end face 1115*a*). The fifth interlock device 1130*e* might be configured to change the tilt angle of the beam(s) of light emitted from the beam alignment device 1125 through the aperture 1120 on the first end face of 1115*a*. When the fifth interlock device 1130*e* is depressed or engaged (e.g., when the fifth interlock device 1130*e* is pushed into the housing of the golf training apparatus 1105 or when the golf training apparatus 1105 is resting on the ground surface) the tilt angle is reduced (but greater than zero degrees, at which the beam of light is aligned with the axis of the arm or aligned with the plane defined by the four arms; this minimum downward tilt allows for longer length of the beam of light while still pointing the light toward the ground surface at a distance relatively close to the user for the user to see the beam of light). When the fifth interlock device 1130*e* is not depressed or not engaged, the tilt angle is set to be between about 5 and about 20 degrees, preferably between about 7 and about 13 degrees.

FIGS. 11A-11F further depict a mounting base 1150 to which the golf training apparatus 1105 may be mounted to raise the golf training apparatus 1105 off the ground surface by a desired height. In some embodiments, the height of the golf training apparatus 1105 can be adjusted using a height adjustment system 1160 (if any) of the mounting base 1150. In some instances, the height (also referred to herein as "beam height"; as shown as height $h_3$ in FIG. 11C or $h_4$ in FIG. 11F) of the aperture 1020 off a ground surface (e.g., ground surface 1185 in FIGS. 1*c*C and 11F) might be between 5 inches (~12.7 cm) and 10 inches (~25.4 cm), between 6 inches (~15.2 cm) and 12 inches (~30.5 cm), preferably 8.5 inches (~21.6 cm) or 9.5 inches (~24.3 cm), or the like. According to some embodiments, the mounting base might alternatively, or additionally, comprise a rotational adjustment system for allowing the golf training apparatus to be rotated relative to a ground surface (or relative to a base portion or feet of the mounting base), an angular tilt adjustment system for allowing the golf training apparatus to be oriented at a variable angle relative to the ground surface (or relative to the base portion or feet of the mounting base), or a combination rotation/tilt adjustment system that allows for both rotation and tilt with respect to the ground surface (or with respect to the base portion or feet of the mounting base).

In the embodiment of FIG. 11, the mounting base 1150 might comprise a base portion 1170 (which might, in some embodiments be shaped as a disk, with or without feet 1175 on a bottom surface thereof), a combination rotation/tilt adjustment system 1165 disposed on (or integrated with) the top surface of the base portion 1170, and a height adjustment system 1160. According to some embodiments, the combination rotation/tilt adjustment system 1165 might comprise a first cylinder, on a top surface of which is disposed a concave opening that is configured to removably couple with at least a portion of a spherical object, which is part of the combination rotation/tilt adjustment system 1165. The height adjustment system 1160 might comprise a second cylinder (which may have a diameter smaller than the diameter of the first cylinder). The second cylinder might be integrated with the at least a portion of the spherical object (collectively, "articulated arm"). The articulated arm, when coupled with the first cylinder, can rotate relative to the first cylinder and can tilt relative to the first cylinder (independent of the rotation). Within the top surface of the second cylinder might be disposed a threaded interface similar to the threaded cylinder of the mount interface 1130.

Figure 11A:
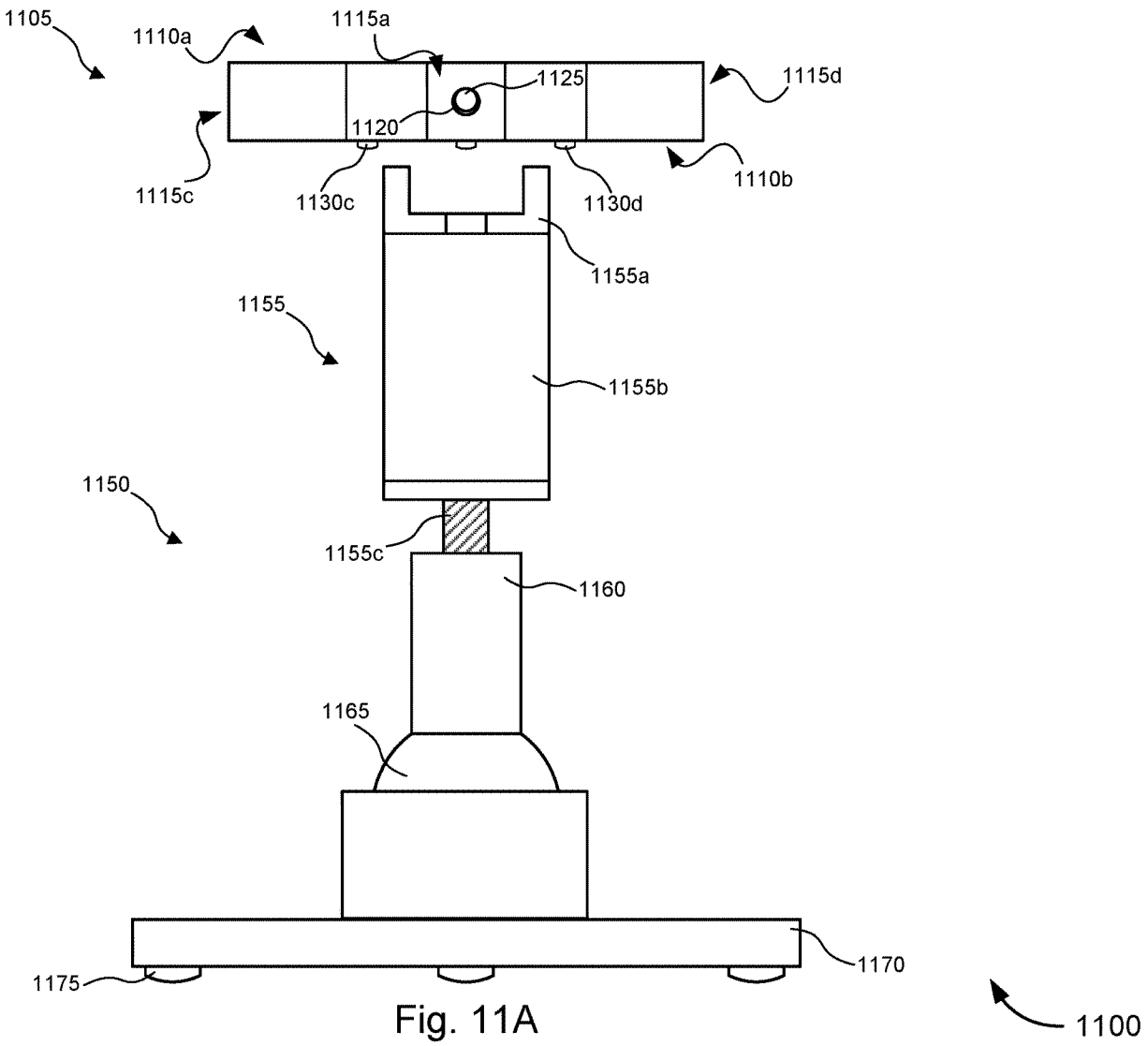
FIGS. 11A-11F illustrate various views of yet another golf training system including another embodiment of a golf training apparatus as well as yet another embodiment of a mounting base.
Figure 11B:
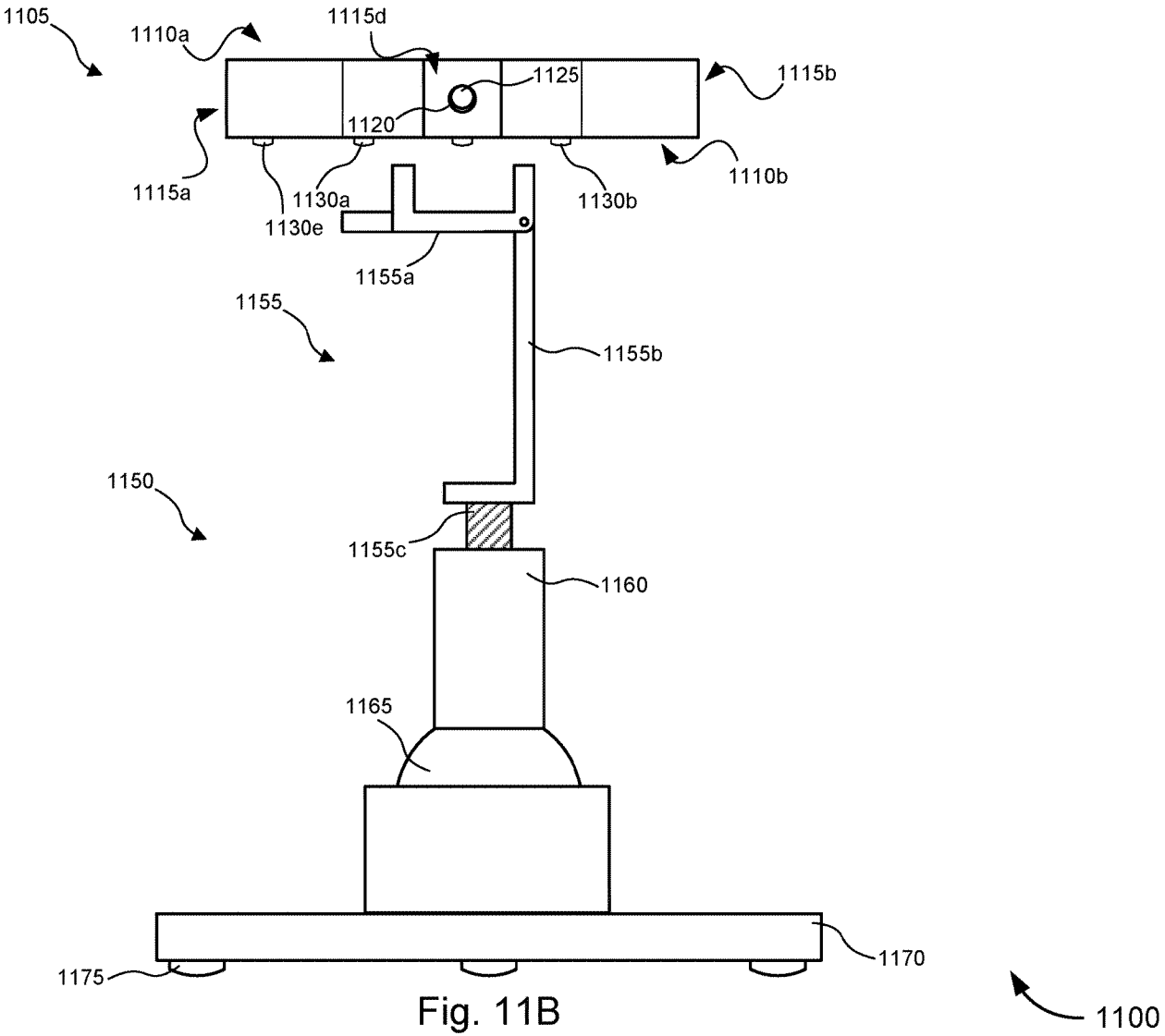
Figure 11C:
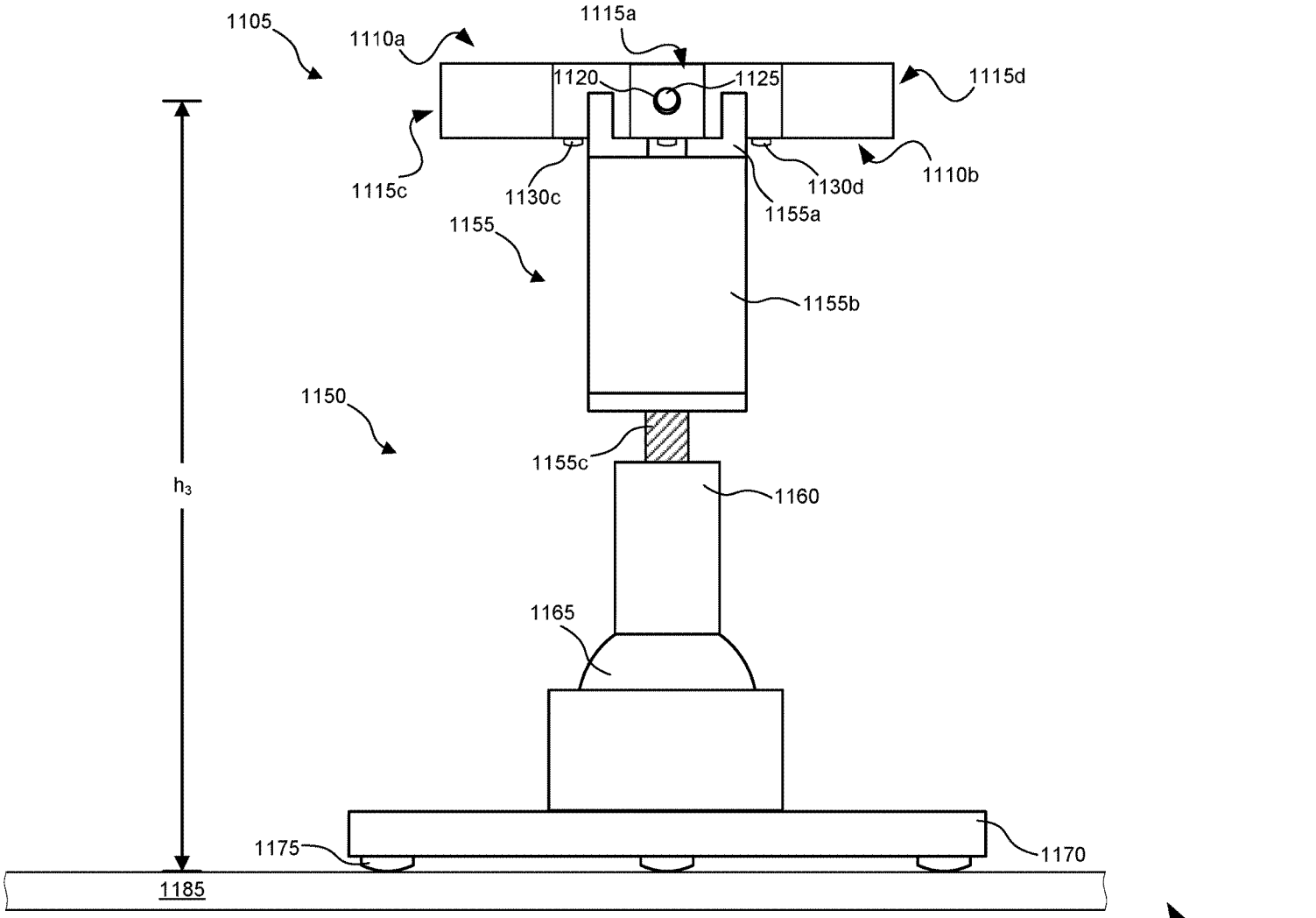
Figures 11D, 11E:
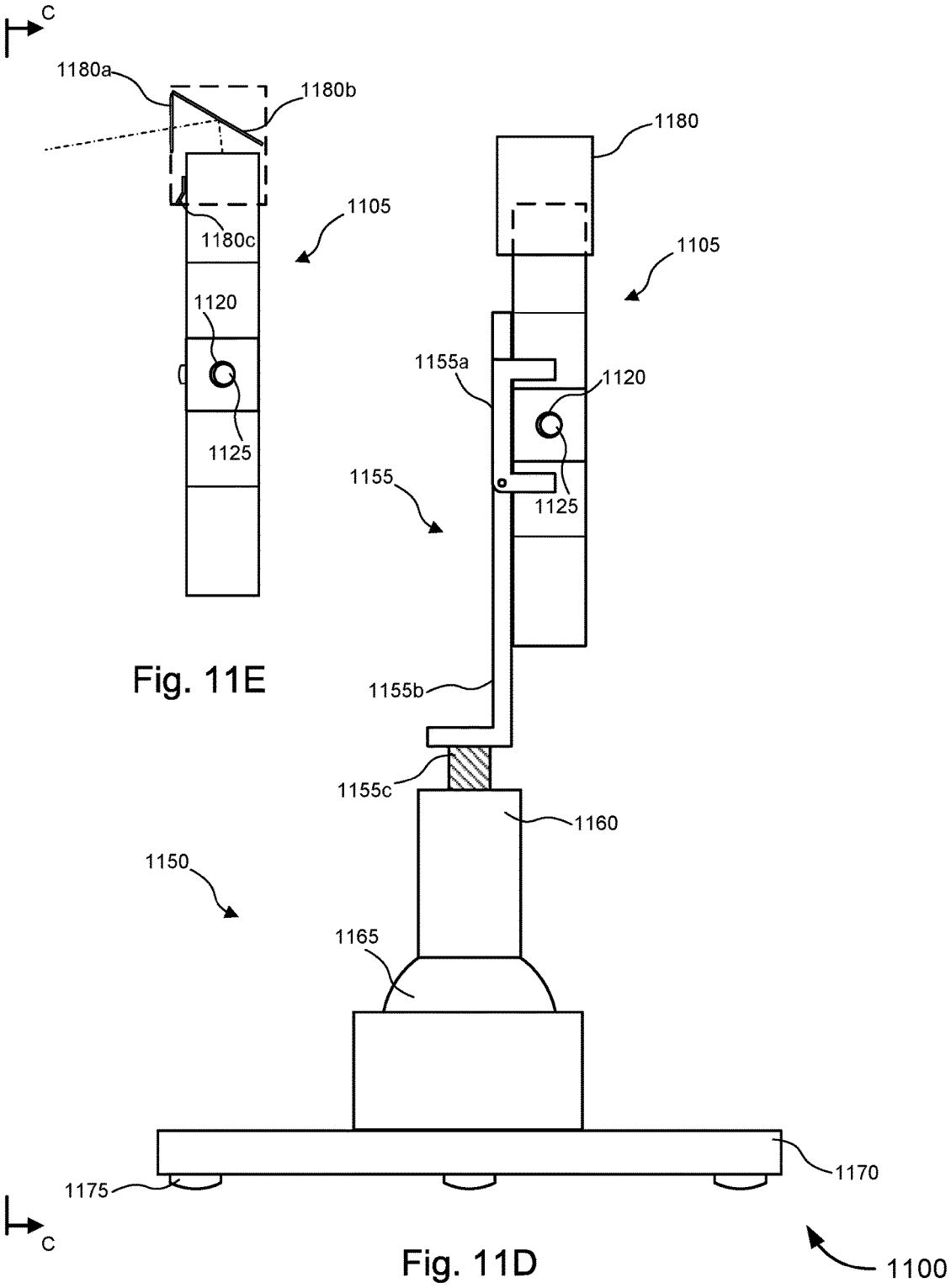
Figure 11F:
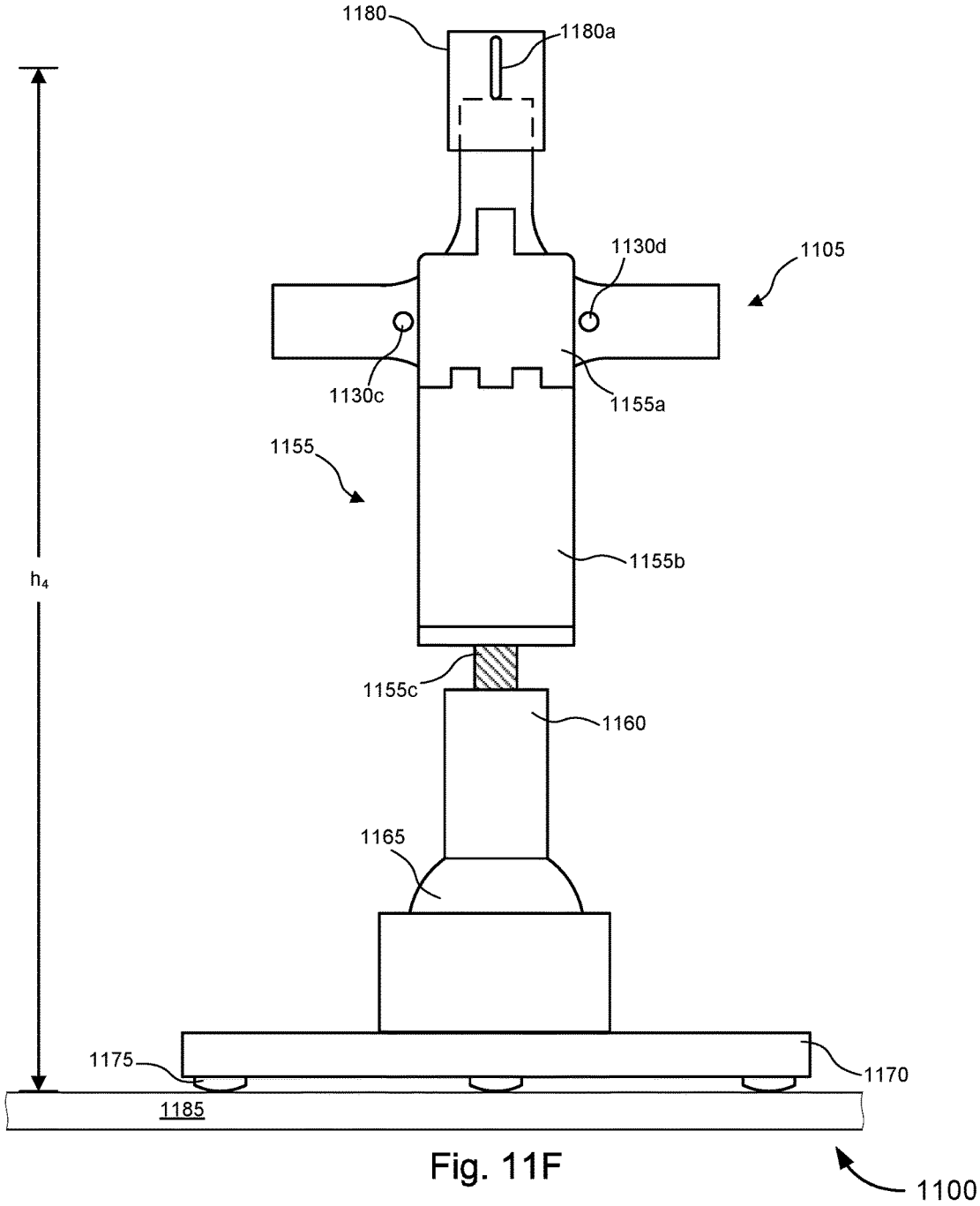

The mounting base 1150 is similar to mounting base 1050 of FIG. 10, except that instead of rod 1055, a foldable platform 1155 is used. In some embodiments, the foldable platform might comprise a first portion 1155*a*, a second portion 1155*b*, and a third portion 1155*c*. The first portion 1155*a* includes, without limitation, a flat base, four arms at the corners of the flat base raising perpendicular to the flat base, an extended portion, and one half of a hinge. The second portion 1155*b* includes, but is not limited to a main portion that is generally L-shaped when seen from the side (e.g., as shown in FIG. 11B). The second portion 1155*b* further includes, at a top end thereof, one half of a hinge that attaches to the half of the hinge in the first portion 1155*a*. The third portion 1155*c* is integrated with or affixed to a bottom surface of the shorter part of the L-shaped second portion 1155*b*, as shown in FIGS. 11B and 11F. In the lowered or folded position, as shown in FIGS. 11A and 11B, the cross-shaped or plus-sign-shaped golf training apparatus 1105 rests on the flat base of the first portion 1155*a*, with the four arms (in the vertical position) hugging the curved sides of the central portion of the golf training apparatus 1105. The extended portion serves to engage or depress the first interlock device 1130*a*. The foldable platform 1155 may be used to interface the golf training apparatus 1105 with the mounting base 1150, by inserting the threaded end 1155*c* of the foldable platform 1155 into the threaded hole of the mounting base 1150.

In use, the golf training system 1100 is placed either behind the ball (i.e., behind the intended direction of travel of the golf ball, as shown in the embodiment of FIG. 13A) or in front of the ball (i.e., in the general direction toward which the golf ball is intended to travel, typically in proximity or behind the cup or hole disposed in the green or putting area, as shown in the embodiment of FIG. 13B). When behind the ball, the height of the golf training system 1100 (particularly, the height of the top surface 1110*a* of the golf training apparatus 1105 that is mounted to the mounting base 1150) should, in some cases, be no higher than about 10 inches (or ~25.4 cm) from the ground surface, which would allow for an appropriate brightness of the beam of light (i.e., so as to be visible to the user or player), without being in the way of the user's swing of his or her club (e.g., wedge, etc.) or putter. In some embodiments, the golf training system 1100 might be positioned about 16 to about 24 inches (~40.6 to ~61.0 cm) from the ball. Any closer does not allow for a full or proper back swing, while any further might result in a brightness of the beam of light being so low as to be difficult for the user to see. According to some embodiments, the beam alignment device(s) 1125 might be positioned, oriented, or configured to emit the beam(s) of light at a downward angle (from the horizontal or from the plane defined by the arms of the golf training apparatus 1105) of between 5 and 20 degrees, preferably between 7 and 13 degrees. In some embodiments, the tilt adjustment system 1165 (or the combination rotation/tilt adjustment system 1165) might be tilted at the desired tilt angle. In some cases, the tilt adjustment system 1165 (or the combination rotation/tilt adjustment system 1165) might include markings at the appropriate angles or at graduated angles to allow the user to orient the system at the desired angles. Likewise, the height adjustment system 1160 might include markings at appropriate heights or at graduated heights to allow the user to configure the system at the desired heights. In some instances, the beam alignment device(s) 1125 might alternatively or additionally provide a fan angle of 12 degrees, 15 degrees, 22 degrees, or 30 degrees, with the larger fan angles producing a longer line for any particular height of the system 1100.

When the foldable platform 1155 is rotated about the hinge so that the flat base of the first portion 1155*a* aligns with the second portion 1155*b* (i.e., when the flat base is rotated about the hinge to lie within the plane defined by the longer portion of the L-shaped second portion 1155*b*), the second interlock device 1130*b* (if any) might be depressed or engaged, thereby allowing the light emitting device or laser to emit a beam(s) of light via the beam alignment device 1125 in the second arm and through the aperture 1120 in the end face 1115*b*. To allow the beam(s) of light in the first arm to be projected onto the ground surface, an external cap 1180 might be placed over at least a portion of the first arm, as shown in FIGS. 11D-11F. As shown FIG. 11D, the dashed line represents the position of the end face 1015*a* relative to the position of the external cap 1180. FIG. 11E shows a cut-out view of the external cap 1180 with respect to the golf training apparatus 1105 (without the mounting base 1150 or with the mounting base 1150 rendered invisible). As shown in FIG. 11E, the external cap 1180 includes, without limitation, a slit aperture 1180*a* through which the beam(s) of light is emitted, a mirror or other optical device 1180*b* that reflects at least the beam(s) of light emitted via the beam alignment device 1125 through the aperture 1120 in the first arm, and a pressing tool or interlock interface 1180*c* that causes the first interlock device to be depressed or engaged when the external cap 1180 is fitted over the at least a portion of the first arm. The dash-dot line in FIG. 11E illustrates the beam(s) of light as emitted from the beam alignment device 1125 through the aperture 1120 of the first arm, reflected off mirror or other optical device 1180*b*, and through slit aperture 1180*a* (and eventually onto the ground surface (not shown)). FIG. 11F depicts the golf training system 1100 of FIGS. 11D and 11E as shown looking along the C-C direction. The slit aperture 1180*a* is shown in FIG. 11F, along with the first and second portions of the foldable platform 1155 in the vertical orientation. As can be seen in FIG. 11F, the third and fourth interlock devices 1130*c* and 1130*d* are not engaged or depressed by the foldable platform 1155, thus preventing the light emitting devices or lasers in the third and fourth arms from being emitted through the beam alignment devices 1125 and the apertures 1120 in the third and fourth arms.

The golf training apparatus 1105 might otherwise be similar, if not identical to, the golf training apparatus 800, 905, or 1005 as shown in, and described above with respect to, FIG. 8, 9, or 10, respectively. Likewise, golf training system 1100 might otherwise be similar, if not identical to, the golf training system 900 or 1000 as shown in, and described above with respect to, FIG. 9 or 10, respectively.

FIGS. 12A-12E (collectively, "FIG. 12") illustrate various views of still another golf training system 1200 including yet another embodiment of a golf training apparatus 1205 as well as still another embodiment of a mounting base 1250. The golf training apparatus 1205, the top and bottom surfaces 1210*a* and 1210*b*, the end faces 1215*a*-1215*d*, the apertures 1220, the beam alignment devices 1225, the first through fifth interlock devices 1230*a*-1230*e*, the mounting base 1250, the foldable platform 1255, the first portion 1255*a*, the second portion 1255*b*, and the third portion 1255*c* of the foldable platform 1255, the height adjustment system 1260, the combination rotation/tilt adjustment system 1265, the base portion 1270 and the feet 1275 of the mounting base 1250, and the external cap 1280 of golf training system 1200 of FIG. 12 correspond to the golf training apparatus 1105, the top and bottom surfaces 1110*a* and 1110*b*, the end faces 1115*a*-1115*d*, the apertures 1120, the beam alignment devices 1125, the first through fifth interlock devices 1130*a*-1130*e*, the mounting base 1150, the foldable platform 1155, the first portion 1155*a*, the second portion 1155*b*, and the third portion 1155*c* of the foldable platform 1155, the height adjustment system 1160, the combination rotation/tilt adjustment system 1165, the base portion 1170 and the feet 1175 of the mounting base 1150, and the external cap 1180 of golf training system 1100 of FIG. 11.

Figures 12A, 12B:
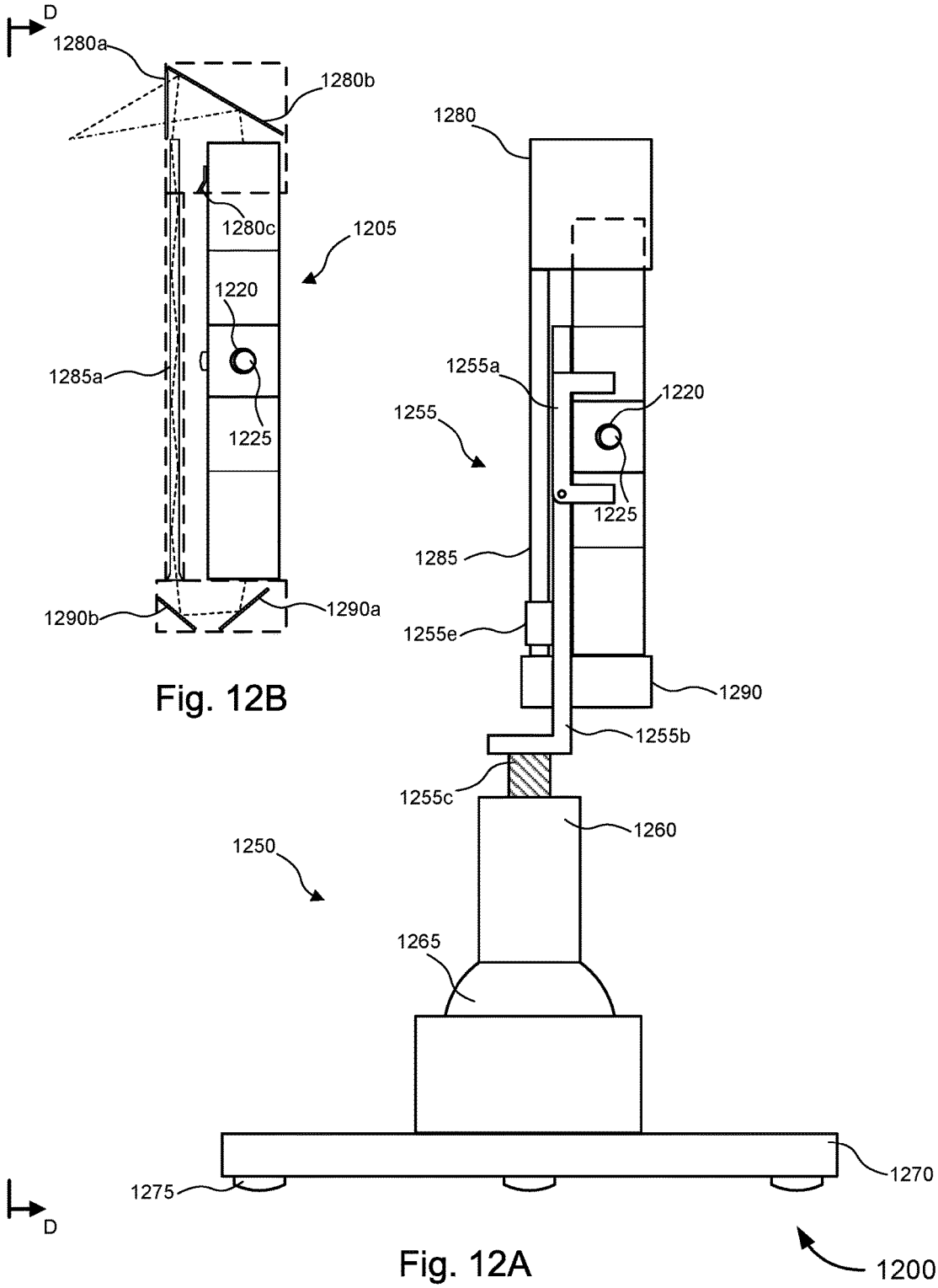
FIGS. 12A-12E illustrate various views of still another golf training system including yet another embodiment of a golf training apparatus as well as still another embodiment of a mounting base.
Figure 12C:
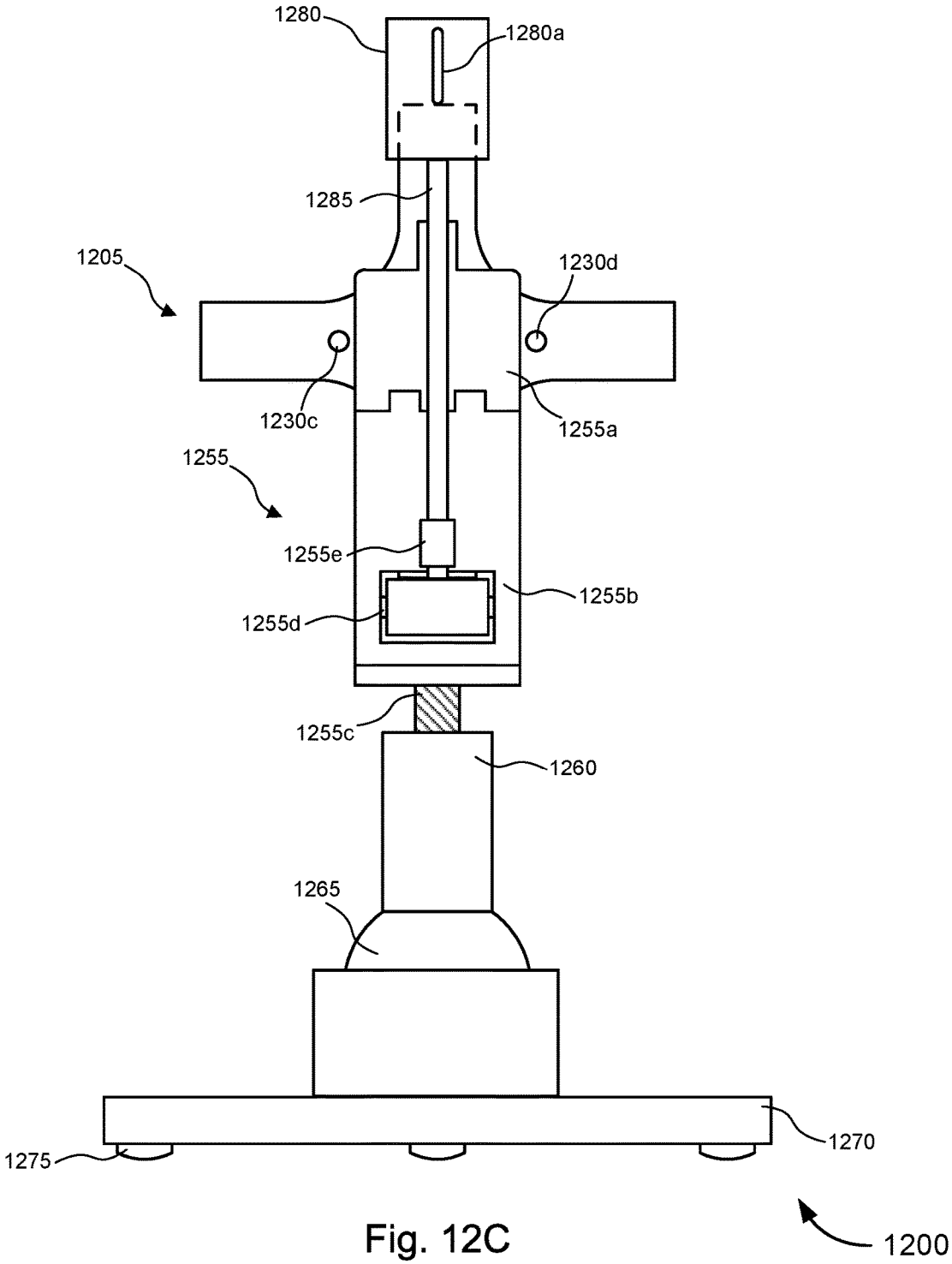
Figure 12D:
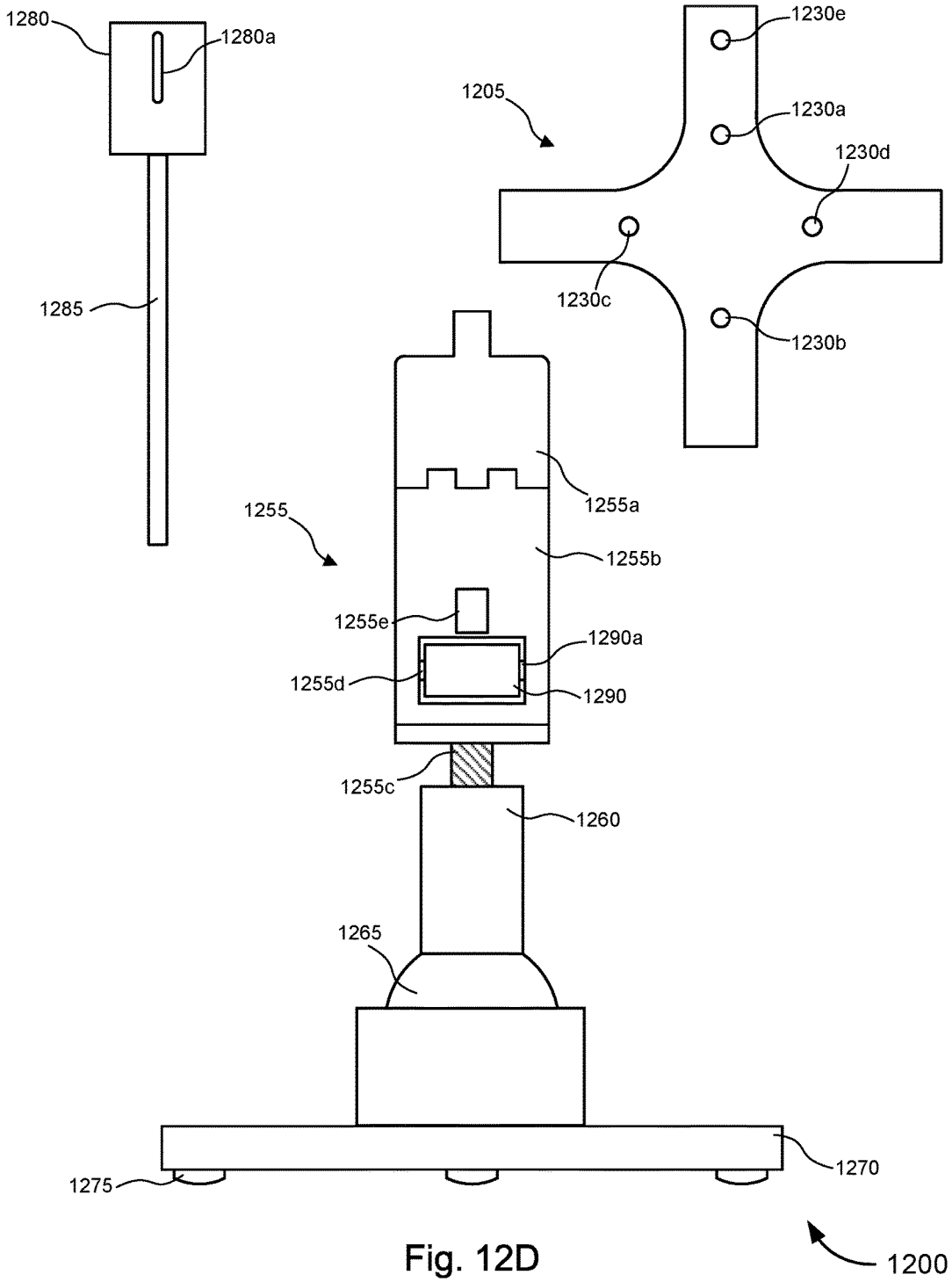
Figure 12E:
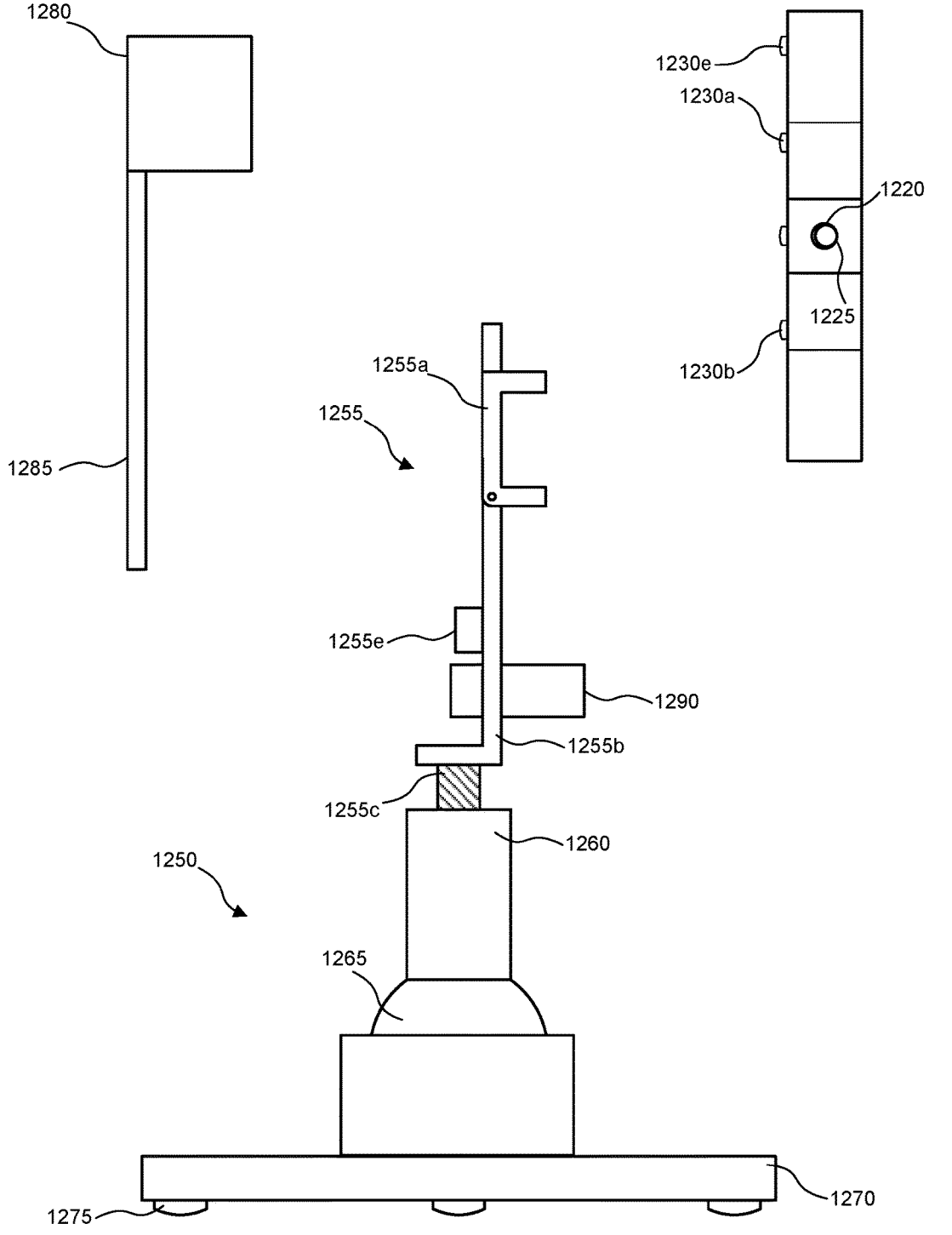

The embodiment of FIG. 12 is similar to the embodiment of FIG. 11, except that the foldable platform further comprises a second external cap 1290 that is integrated or affixed to an opening in the longer portion of the L-shaped second portion 1255*b* of the foldable platform 1255 via a connector 1255*d* (as shown in FIGS. 12C and 12D). The first external cap 1280 further comprises a beam alignment shaft 1285 integrated with or affixed to a bottom portion thereof. The second portion 1255*b* further comprises a guide slot 1255*e* through which the beam alignment shaft 1285 would fit when the first external cap 1280 is placed over at least a portion of the first arm of the golf training apparatus 1205, as shown in FIGS. 12A and 12C. FIGS. 12D and 12E depict the golf training apparatus 1205, the mounting base 1250, and the first external cap 1280 being separate from each other. FIGS. 12C and 12D depict the golf training system 1200 of FIGS. 12A and 12B as shown looking along the D-D direction.

With reference to FIG. 12B, a cut-out view is shown of the first external cap 1280, the beam alignment shaft 1285, and the second external cap 1290. Similar to external cap 1180 of FIG. 11, the first external cap 1280 includes, without limitation, a slit aperture 1280*a* through which the beam(s) of light is emitted, a mirror or other optical device 1280*b* that reflects at least the beam(s) of light emitted via the beam alignment device 1225 through the aperture 1220 in the first arm, and a pressing tool or interlock interface 1280*c* that causes the first interlock device to be depressed or engaged when the external cap 1280 is fitted over the at least a portion of the first arm. The dash-dot line in FIG. 12B illustrates the beam(s) of light as emitted from the beam alignment device 1225 through the aperture 1220 of the first arm, reflected off mirror or other optical device 1280*b*, and through slit aperture 1280*a* (and eventually onto the ground surface (not shown)). The second external cap 1290 includes, but is not limited to, two or more mirrors or other optical devices 1290*a* and 1290*b* that reflect the beam(s) of light emitted—from the light emitting device(s) or laser(s) in the second arm via the beam alignment device 1225 through the aperture 1220 in the second arm—into the beam alignment shaft 1285, which includes, without limitation, an internal reflection path 1285*a* (which might comprise one or more of at least one fiber optical cable, at least one reflective surface, a polygonal prism characterized by total internal reflection (i.e., having an internal path index of refraction or refractive index higher than the index of refraction or refractive index of the surrounding medium within the beam alignment shaft 1285, etc.), or the like. The beam alignment shaft 1285 collects the beam(s) of light reflected by the second external cap and focuses the beam(s) of light on a portion of the mirror or other optical device 1280*b*, which reflects the beam(s) of light through the slit aperture 1280*a* (and eventually onto the ground surface (not shown)). The dash line in FIG. 12B illustrates the beam(s) of light as emitted from the beam alignment device 1225 through the aperture 1220 of the second arm, reflected off mirrors or other optical devices 1290*a* and 1290*b* of the second external cap 1290, through the internal reflection path 1285*a* of the beam alignment shaft 1285, reflected off mirror or other optical device 1280*b*, and through slit aperture 1280*a* (and eventually onto the ground surface (not shown)), with the beam(s) of light emitted from the second arm combined with the beam(s) of light emitted from the first arm. Any signal intensity loss of the beam(s) of light when reflected off one or more reflective surfaces (e.g., mirrors or other optical devices 1280*b*, 1290*a*, 1290*b*, and 1285*a*) may be compensated by the combination of the two sets of beam(s) of light (i.e., as emitted from both the first arm and the second arm).

Although not shown, the golf training apparatus 1205, in some embodiments, might further comprise a sixth interlock device 1230*f* that is internal to a portion of the second arm portion. The sixth interlock device 1230*f*, when engaged or depressed, prevents the first beam of light from being emitted from the first aperture and prevents the second beam of light from being emitted from the second aperture, and that, when disengaged or not depressed, allows the first and second beams of light to be emitted. In such embodiments, the foldable platform 1255 might further comprise an actuator that causes the sixth interlock device 1230*f* to disengage (not shown) when the beam alignment shaft 1285 locks into position within the guide slot 1255*e*. In some embodiments, the second external cap 1290 might be stationary with respect to the foldable platform 1255 (as shown in the embodiment of FIG. 12). Alternatively, the second external cap 1290 might be configured to be movable along the vertical direction. In such cases, when the beam alignment shaft 1295 locks into position within the guide slot 1255*e*, the beam alignment shaft 1295 further causes a lifting mechanism (not shown) to shift the second external cap upward to fit over at least a portion of the second arm (in a similar manner as the first external cap fitting over at least a portion of the first arm).

The golf training apparatus 1205 might otherwise be similar, if not identical to, the golf training apparatus 800, 905, 1005, or 1105 as shown in, and described above with respect to, FIG. 8, 9, 10, or 11, respectively. Likewise, golf training system 1200 might otherwise be similar, if not identical to, the golf training system 900, 1000, or 1100 as shown in, and described above with respect to, FIG. 9, 10, or 11, respectively.

FIGS. 13A and 13B (collectively, "FIG. 13") illustrate various plan views of a golf training system 1300 assisting a golfer's alignment with a target line, a ball 1315, and a cup or hole 1320 cut into the green, in accordance with various embodiments. As described above, FIG. 13A depicts the golf training system 1300 (which comprises the golf training apparatus 1305 mounted on the mounting base 1310) being placed behind the ball 1315 (i.e., behind the intended direction of travel of the golf ball). As shown in FIG. 13A, when the beam(s) of light is elevated (i.e., with the golf training apparatus 1305 mounted in a manner as shown in, and described above with respect to, FIGS. 8-12) and angled or tilted downward (between about 5 and about 20 degrees, preferably between about 7 and about 13 degrees), the beam(s) of light would connect with the golf ball 1315, a portion of the beam(s) of light being occluded by the ball 1315, with the rest of the beam(s) of light continuing past the ball, the beam(s) of light being pointed in the direction of a putt (either on an indoor surface (e.g., carpet or the like) or an outdoor surface (e.g., putting green, or the like). The direction of the putt can either be in line with the cup or hole 1320 cut into the putting surface or resting on the putting surface (in the case of an indoor setup), or can be aligned to the left or right of the cup or hole 1320 to account for contours in the putting surface that might cause the golf ball 1315 to roll when struck by a putter. Ideally, the golf training system 1300 is positioned so that the beam(s) of light aligns with a direction that allows the ball 1315, when struck with a particular force by the putter, to travel along any contoured surfaces in the putting surface toward the cup or hole 1320. In some cases, hitting with greater force might result in the ball 1315 travelling with less of a turn down a contoured surface, but might result in ball hitting the rim of the cup or hole 1320 and bouncing off; in other cases, hitting with lesser force might reduce the chances of the golf ball bouncing off the cup or hole 1320, but might allow gravity to force the ball to roll more along the contoured surface. With practice, the user can gauge what direction to point the golf training system 1300 and with what force to apply, when faced with any variety of contoured surfaces of the putting surface. Once fully confident, the user need no longer use the golf training system 1300 to align his or her putts.

Also as described above, FIG. 13B depicts the golf training system 1300 (which comprises the golf training apparatus 1305 mounted on the mounting base 1310) being placed in front of the ball 1315 (i.e., in the general direction toward which the golf ball is intended to travel, typically in proximity or behind the cup or hole disposed in the green or putting area). In such embodiments, the golf training system 1300 can be positioned so as to point the beam(s) of light directly at the golf ball 1315 along a direction of the putt. As above, the golf training system 1300 is positioned so that the beam(s) of light aligns with a direction that allows the ball 1315, when struck with a particular force by the putter, to travel along any contoured surfaces in the putting surface toward the cup or hole 1320. With practice, the user can gauge what direction to point the golf training system 1300 and with what force to apply, when faced with any variety of contoured surfaces of the putting surface. Once fully confident, the user need no longer use the golf training system 1300 to align his or her putts.

The golf training apparatus 1305 might otherwise be similar, if not identical to, the golf training apparatus 800, 905, 1005, 1105, or 1205 as shown in, and described above with respect to, FIG. 8, 9, 10, 11, or 12, respectively. Likewise, golf training system 1300 might otherwise be similar, if not identical to, the golf training system 900, 1000, 1100, or 1200 as shown in, and described above with respect to, FIG. 9, 10, 11, or 12, respectively.

Although the above has been described with respect to putting, the configuration shown in FIG. 13A or FIG. 13B may also be used for chipping.

FIGS. 14A and 14B (collectively, "FIG. 14") are process flow diagrams illustrating various methods 1400 and 1400', respectively, of golf training, in accordance with various embodiments. FIG. 14A depicts a method that is consistent with the embodiments of FIG. 13A, while FIG. 14B depicts a method that is consistent with the embodiments of FIG. 13B.

While the techniques and procedures are depicted and/or described in a certain order for purposes of illustration, it should be appreciated that certain procedures may be reordered and/or omitted within the scope of various embodiments. Moreover, while the method 1400 illustrated by FIG. 14 can be implemented by or with (and, in some cases, are described below with respect to) the systems 800, 900, 1000, 1100, 1200, and 1300 of FIGS. 8, 9, 10, 11, 12, and 13, respectively (or components thereof), such methods may also be implemented using any suitable hardware (or software) implementation. Similarly, while each of the systems 800, 900, 1000, 1100, 1200, and 1300 of FIGS. 8, 9, 10, 11, 12, and 13, respectively (or components thereof), can operate according to the method 1400 illustrated by FIG. 16 (e.g., by executing instructions embodied on a computer readable medium), the systems 800, 900, 1000, 1100, 1200, and 1300 of FIGS. 8, 9, 10, 11, 12, and 13 can each also operate according to other modes of operation and/or perform other suitable procedures.

In FIG. 14A, method 1400 might comprise, at block 1405, positioning the device (i.e., the golf training system) behind the golf ball, with the light beam facing in the direction of the putt (or chip), taking into account the contour of the putting surface (i.e., the putting green). At block 1410, method 1400 might comprise controlling operation of the device (e.g., turning on the beam(s) of light). Method 1400 might further comprise evaluating alignment of the device (i.e., the golf training system) (block 1415), and, if necessary, modifying alignment of the device (i.e., the golf training system) (block 1420). Once the user has aligned the device (i.e., the golf training system) to take into account the direction of that the ball with travel when struck (either by the putter or by a wedge), the user can address the ball (block 1425) and proceed to hit the ball.

In FIG. 14B, method 1400' might comprise, at block 1405', positioning the device (i.e., the golf training system) in front of the golf ball, with the light beam facing or targeting the golf ball, the light beam being positioned parallel with the direction of the putt (or chip), taking into account the contour of the putting surface (i.e., the putting green). At block 1410, method 1400 might comprise controlling operation of the device (e.g., turning on the beam(s) of light). Method 1400 might further comprise evaluating alignment of the device (i.e., the golf training system) (block 1415), and, if necessary, modifying alignment of the device (i.e., the golf training system) (block 1420). Once the user has aligned the device (i.e., the golf training system) to take into account the direction of that the ball with travel when struck (either by the putter or by a wedge), the user can address the ball (block 1425) and proceed to hit the ball.

While certain features and aspects have been described with respect to exemplary embodiments, one skilled in the art will recognize that numerous modifications are possible. For example, the methods and processes described herein may be implemented using hardware components, software components, and/or any combination thereof. Further, while various methods and processes described herein may be described with respect to particular structural and/or functional components for ease of description, methods provided by various embodiments are not limited to any particular structural and/or functional architecture but instead can be implemented on any suitable hardware, firmware, and/or software configuration. Similarly, while certain functionality is ascribed to certain system components, unless the context dictates otherwise, this functionality can be distributed among various other system components in accordance with the several embodiments.

Moreover, while the procedures of the methods and processes described herein are described in a particular order for ease of description, unless the context dictates otherwise, various procedures may be reordered, added, and/or omitted in accordance with various embodiments. Moreover, the procedures described with respect to one method or process may be incorporated within other described methods or processes; likewise, system components described according to a particular structural architecture and/or with respect to one system may be organized in alternative structural architectures and/or incorporated within other described systems. Hence, while various embodiments are described with—or without—certain features for ease of description and to illustrate exemplary aspects of those embodiments, the various components and/or features described herein with respect to a particular embodiment can be substituted, added, and/or subtracted from among other described embodiments, unless the context dictates otherwise. Consequently, although several exemplary embodiments are described above, it will be appreciated that the invention is intended to cover all modifications and equivalents within the scope of the following claims.

What is claimed is:

1. A golf training apparatus, comprising:

a housing;

a plurality of apertures disposed on one or more surfaces of the housing;

one or more lasers disposed within the housing for emitting one or more beams of light within a visible spectrum; and a beam alignment device disposed within the housing, the beam alignment device being configured to direct a first beam of light and a second beam of light through one or more apertures, the first beam of light being directed along a target axis defining an intended target line of a golf ball to be struck by a user and the second beam of light being directed along an alignment axis corresponding to a stationary position of the golf ball relative to a stance of the user, wherein, based on a control circuit, the beam alignment device, in a first state, directs the first beam of light to be emitted through a first aperture among the plurality of apertures at a first angle relative to the target axis, and, in a second state, directs the first beam of light to be emitted through the first aperture at a second angle relative to the target axis, the second angle being different from the first angle.

2. The golf training apparatus of claim 1, further comprising:

a control device to receive input from the user; wherein the control circuit is in electrical communication with the one or more lasers and the control device, the control circuit being configured to control operation of the one or more lasers based at least in part on the input received by the control device.

3. The golf training apparatus of claim 2, wherein the housing has a general shape corresponding to a rectangular prism, with four longitudinal side surfaces, a square base surface, and a square top surface, wherein the control device comprises a user interface device disposed on at least a portion of the square top surface, wherein at least one aperture is disposed on a first longitudinal side surface of the four longitudinal side surfaces at a position along the first longitudinal side surface that is proximate to the square top surface.

4. The golf training apparatus of claim 3, wherein at least one aperture of the plurality of apertures defines one of a circular or an oval shape on the first longitudinal side surface of the housing.

5. The golf training apparatus of claim 3, wherein the control device comprises at least one of one or more buttons, one or more switches, one or more wireless transceiver ports, one or more Bluetooth transceivers, one or more Infrared transceivers, one or more radio frequency transceivers, one or more microphones, or one or more motion capture devices.

6. The golf training apparatus of claim 2, wherein the housing has a general shape corresponding to a cylinder, with a wrapped rectangular surface, a circular base surface, and a circular top surface, wherein the control device comprises a user interface device disposed on at least a portion of the circular top surface, wherein each of the plurality of apertures is disposed on the wrapped rectangular surface at one or more positions along the wrapped rectangular surface that is proximate to the circular top surface.

7. The golf training apparatus of claim 6, wherein at least one aperture of the plurality of apertures defines one of a circular or an oval shape on the wrapped rectangular surface of the housing.

8. The golf training apparatus of claim 1, wherein the housing comprises a base surface, which comprises a mount interface that communicatively couples to a mounting base, the mounting base being configured to support the housing of the golf training apparatus in a stable orientation on a ground surface.

9. The golf training apparatus of claim 8, wherein the mounting base comprises a height adjustment system that allows adjustment of the height of the housing of the golf training apparatus relative to the ground surface.

10. The golf training apparatus of claim 8, wherein the mounting base is configured to allow the housing to rotate relative to the ground surface.

11. The golf training apparatus of claim 8, wherein the mounting base is configured to allow the housing to be disposed at a variable angle relative to the ground surface.

12. The golf training apparatus of claim 1, wherein the beam alignment device comprises at least one of one or more prisms or one or more lenses.

13. A golf training method, comprising:

aligning a golf training apparatus with respect to a target location, the golf training apparatus comprising:

a housing;

a plurality of apertures disposed on one or more surfaces of the housing;

one or more lasers disposed within the housing for emitting one or more beams of light within a visible spectrum; and a beam alignment device disposed within the housing, the beam alignment device being configured to direct a first beam of light and a second beam of light through one or more of the apertures, the first beam of light being directed along a target axis defining an intended target line of a golf ball to be struck by a user and the second beam of light being directed along an alignment axis corresponding to a stationary position of the golf ball relative to a stance of the user, wherein, based on a control circuit, the beam alignment device, in a first state, directs the first beam of light to be emitted through a first aperture among the plurality of apertures at a first angle relative to the target axis, and, in a second state, directs the first beam of light to be emitted through the first aperture at a second angle relative to the target axis, the second angle being different from the first angle; and placing the golf ball on the alignment axis; and evaluating an alignment of the user addressing the golf ball, based at least in part on the position of the user relative to at least one of the first or second beams of light.

14. The golf training method of claim 13, further comprising:

modifying the alignment of the user, based at least in part on the position of the user relative to at least one of the first or second beams of light.

15. The golf training method of claim 13, further comprising:

controlling operation of the golf training apparatus using one of a software program on a wireless phone or a remote control device.

16. The golf training method of claim 13, wherein the golf training apparatus comprises a control device comprising at least one of one or more buttons, one or more switches, one or more microphones, or one or more motion capture devices, wherein the method further comprises:

controlling operation of the golf training apparatus by interacting with the at least one of the one or more buttons, the one or more switches, the one or more microphones, or the one or more motion capture devices.

* * * * *